US008682515B2

(12) United States Patent
Ito

(10) Patent No.: US 8,682,515 B2
(45) Date of Patent: Mar. 25, 2014

(54) MARINE VESSEL CONTROL SYSTEM, MARINE VESSEL PROPULSION SYSTEM, AND MARINE VESSEL

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1011 days.

(21) Appl. No.: 12/644,904

(22) Filed: Dec. 22, 2009

(65) Prior Publication Data

US 2010/0305789 A1 Dec. 2, 2010

(30) Foreign Application Priority Data

May 29, 2009 (JP) ..... 2009-131388

(51) Int. Cl.
*B63H 21/22* (2006.01)
*B63H 5/00* (2006.01)
*B63H 19/00* (2006.01)

(52) U.S. Cl.
USPC ..... 701/21; 701/99; 440/84; 440/87

(58) Field of Classification Search
USPC ..... 701/21, 99; 440/3, 84, 87
See application file for complete search history.

(56) References Cited

U.S. PATENT DOCUMENTS

| | | | | |
|---|---|---|---|---|
| 7,559,815 | B2 * | 7/2009 | Okuyama et al. | 440/84 |
| 7,993,175 | B2 * | 8/2011 | Hiroshima et al. | 440/84 |
| 2003/0092331 | A1 * | 5/2003 | Okuyama | 440/84 |
| 2007/0082565 | A1 * | 4/2007 | Okuyama | 440/1 |
| 2007/0082567 | A1 | 4/2007 | Okuyama | |
| 2007/0227429 | A1 | 10/2007 | Okuyama et al. | |
| 2007/0270055 | A1 | 11/2007 | Ito et al. | |
| 2007/0293102 | A1 | 12/2007 | Okuyama et al. | |
| 2008/0269970 | A1 | 10/2008 | Yamada | |

FOREIGN PATENT DOCUMENTS

| | | | |
|---|---|---|---|
| JP | 2003-200895 | A | 7/2003 |
| JP | 2006-282171 | A | 10/2006 |
| JP | 2007-091014 | A | 4/2007 |
| JP | 2007-099175 | A | 4/2007 |
| JP | 2007-261361 | A | 10/2007 |
| JP | 2007-001360 | A | 11/2007 |
| JP | 2008-273365 | A | 11/2008 |

OTHER PUBLICATIONS

Official Communication issued in corresponding European Patent Application No. 09179694.6, mailed on Jan. 31, 2013.

* cited by examiner

*Primary Examiner* — Thomas Tarcza
*Assistant Examiner* — Adam Tissot
(74) *Attorney, Agent, or Firm* — Keating & Bennett, LLP

(57) ABSTRACT

A marine vessel control system includes a control unit, a first communication bus, a second communication bus, and an auxiliary device connection section. The control unit includes a main output section arranged to output marine vessel maneuvering control information including starting information of a marine vessel propulsion device, and a sub output section arranged to output backup information including the starting information of the marine vessel propulsion device. The first communication bus is connected to the marine vessel propulsion device and the control unit, and is arranged to transmit the marine vessel maneuvering control information to the marine vessel propulsion device. The second communication bus is connected to the marine vessel propulsion device and the control unit, and is arranged to transmit the backup information to the marine vessel propulsion device. The second communication bus includes an auxiliary device connection section that is arranged to enable connection of an auxiliary device that executes communication, related to auxiliary information other than the marine vessel maneuvering control information, with at least one of the marine vessel propulsion device and the control unit via the second communication bus.

19 Claims, 18 Drawing Sheets

MARINE VESSEL CONTROL SYSTEM, MARINE VESSEL PROPULSION SYSTEM, AND MARINE VESSEL

BACKGROUND OF THE INVENTION

1. Field of the Invention

The present invention relates to a marine vessel control system for a marine vessel that includes a marine vessel propulsion device, and to a marine vessel propulsion system and a marine vessel that include such a marine vessel control system.

2. Description of the Related Art

An exemplary marine vessel propulsion device is an outboard motor that is attached to a stern of a marine vessel. The outboard motor includes an engine, a propeller, and a shift mechanism. The shift mechanism is provided in a power transmission path between the engine and the propeller. The shift mechanism has a plurality of shift positions. The plurality of shift positions are a forward drive position, a neutral position, and a reverse drive position. The forward drive position is a shift position at which the rotation of a driveshaft that is driven by the engine is transmitted to the propeller shaft to rotate the propeller shaft in the forward drive direction. The reverse drive position is a shift position at which the rotation of the driveshaft is transmitted to the propeller shaft to rotate the propeller shaft in the reverse drive direction. The neutral position is a shift position at which the rotation of the driveshaft is not transmitted to the propeller shaft, that is, the power transmission path is interrupted.

The outboard motor is provided with a steering mechanism for changing the direction (steering angle) of the outboard motor with respect to the hull. The heading direction of the marine vessel can be adjusted by adjusting the steering angle. In some cases, the steering mechanism is arranged from a power steering apparatus that includes a steering actuator, such as an electromotive actuator, a hydraulic actuator, etc.

Steering of the marine vessel having the outboard motor includes adjustment of an engine output, selection of the shift position, and adjustment of the steering angle. The adjustment of the engine output and the selection of the shift position are performed by operation of a remote control lever included in a marine vessel maneuvering compartment. The adjustment of the steering angle is performed by operation of a steering handle included in the marine vessel maneuvering compartment.

In some cases, a drive-by-wire (DBW) system, which electrically transmits the operation of the remote control lever to the outboard motor, is adopted. In this case, a remote control unit includes a position sensor, which detects the operation of the remote control lever, and an electronic control unit (hereinafter referred to as "remote controller ECU") that processes an output signal of the position sensor. The remote controller ECU outputs a throttle opening degree command (engine rotational speed command) and a shift position command. The outboard motor includes an electronic control unit (hereinafter referred to as "outboard motor ECU") that processes the commands from the remote controller ECU. The outboard motor ECU controls a throttle opening degree of the engine in accordance with the throttle opening degree command and controls the shift position of the shift mechanism in accordance with the shift position command.

Likewise in some cases, a steer-by-wire (SBW) system, which electrically transmits the operation of the steering handle to the steering mechanism, is adopted. In this case, an operation angle sensor, which detects a rotation position of the steering handle, and an electronic control unit (hereinafter referred to as "steering ECU") that processes an output signal of the operation angle sensor, are included. Also, a steering actuator is included as a power source in the steering mechanism. The steering ECU outputs a steering angle command. The steering angle command is sent to the outboard motor ECU. The outboard motor ECU controls the steering actuator based on the steering angle command.

Connection between the remote controller ECU and the outboard motor ECU is made by a communication bus. In the case where the steering ECU is included, the steering ECU is also connected to the communication bus. Communication between the remote controller ECU and the outboard motor ECU and communication between the steering ECU and the outboard motor ECU are performed via the communication bus.

In some cases, a marine vessel is provided with a plurality of marine vessel maneuvering compartments. For example, in some cases, a marine vessel structure includes a main marine vessel maneuvering compartment disposed at a first floor and a submarine vessel maneuvering compartment disposed at a second floor. There are also cases in which a marine vessel structure includes a main marine vessel maneuvering compartment disposed at a hull center, a first sub marine vessel maneuvering compartment disposed near a stem, and a second submarine vessel maneuvering compartment disposed near a stern. In such cases where a plurality of marine vessel maneuvering compartments are provided, each marine vessel maneuvering compartment includes a remote controller ECU and a steering ECU, and all of these are connected to the communication bus.

Meanwhile, the number of outboard motors is also not limited to one. For example, a multiple-outboard motor equipped arrangement, in which two or more outboard motors are attached side-by-side to the stern, is adopted in some cases. In this case, a remote controller ECU is provided for each outboard motor, and to each outboard motor ECU, the corresponding remote controller ECU is connected via a communication bus. Communication buses of a number corresponding to the number of outboard motors are thus provided.

When a disconnection or other fault occurs in the communication bus, marine vessel maneuvering control information (throttle opening degree command, shift position command, steering angle command, etc.) cannot be provided from the remote controller ECU or the steering ECU to the outboard motor ECU. Thus, in United States Patent Application Publication No. US 2007/082567 A1, the communication bus is arranged as a dual system. That is, the connection between a remote controller ECU and an outboard motor ECU is made by two communication buses. Thus, even when a fault occurs in one of the communication buses, communication among the ECUs can be performed via the other communication bus.

SUMMARY OF THE INVENTION

The inventors of preferred embodiments of the present invention described and claimed in the present application conducted an extensive study and research regarding a marine vessel control system, such as the one described above, and in doing so, discovered and first recognized new unique challenges and previously unrecognized possibilities for improvements as described in greater detail below.

That is, the number of components is high with the above-described arrangement where a communication bus is provided for each of a plurality of outboard motors. The wiring work for constructing the marine vessel control system is thus complicated and the working time is long accordingly. Also, complex wiring work tends to cause wiring errors by a wiring worker and tends to invite loss of function due to the wiring work errors. Rewiring work, etc., is thus generated and the work efficiency becomes poor.

An arrangement of a communication bus in common for the plurality of outboard motors may thus be considered. In this case, the capacity of the communication bus must be determined based on an assumed maximum communication volume. This is because the number of outboard motors and the number of marine vessel maneuvering compartments are determined arbitrarily by a boat builder in accordance with desires of a user, and the communication bus must thus be able to accommodate any assumed and arbitrary system arrangement. For example, if the maximum number of outboard motors is five and the maximum number of marine vessel maneuvering compartments is three, the capacity of the communication bus must be deigned to enable trouble-free communication of the marine vessel maneuvering control information among five outboard motor ECUs and ECUs respectively included in the three marine vessel maneuvering compartments. It is known that in general, the possibility of occurrence of lowering of response performance increases when a bus load becomes not less than approximately 40% of the bus capacity. The bus capacity is thus preferably designed such that the maximum communication volume does not reach 40% of the bus capacity. Also, the communication bus is preferably arranged as a dual system in preparation for faults of the communication bus, and thus a pair of communication buses, each having a capacity that can accommodate the assumed maximum communication volume such as that mentioned above, must be prepared if the arrangement of US 2007/0082567 A1 is to be followed.

However, when a fault is not occurring in the communication buses, communication by one of the communication buses is sufficient, and thus although the other communication bus communicates an equivalent volume of communication data, the communication data flowing through the other communication bus are practically unused. The communication data volume flowing through the communication buses as a whole is thus not used efficiently.

Meanwhile, as indicated in US 2007/0082567 A1, there are cases where various auxiliary devices are added to extend the functions of the marine vessel. An instrument panel (gauge) can be cited as an example of auxiliary devices. Besides such auxiliary devices, there are those that exhibit functions by performing information communication with the remote controller ECU and the outboard motor ECU. If such auxiliary devices are to be connected to the communication bus for the transmission of marine vessel maneuvering control information, the overall communication data volume increases and the bus capacity of the communication bus must thus be increased further.

US 2007/0082567 A1 discloses an arrangement where an information system bus is provided apart from the communication bus described above, and the auxiliary devices are connected to the information system bus. By adopting this arrangement, the need to increase the capacity of the communication bus in preparation for connection of the auxiliary devices is eliminated. However, by the provision of the information bus in addition to the communication bus, the overall number of buses increases. The arrangement of the communication system is thus made complex, and accordingly, the trouble and time required for constructing the communication system increase. Also, a process (gateway process) of transferring data necessary for use of the auxiliary devices from the communication bus for the outboard motor ECU to the information system bus must be performed by the remote controller ECU. The processing load of the remote controller ECU thus increases and leeway for incorporating other processes with additional functions decreases.

There is thus an unsolved challenge that when bus design is performed in consideration of the responsiveness of the marine vessel maneuvering information transmission and the backup in case of fault occurrence, the communication data volume flowing through the communication bus cannot be used efficiently. There is also an unsolved challenge that when an information system bus is added for connection of auxiliary device, the system arrangement is made complex and the trouble and time required for system construction increase.

In order to overcome the previously unrecognized and unsolved challenges described above, a preferred embodiment of the present invention provides a marine vessel control system for a marine vessel that includes a marine vessel propulsion device. The marine vessel control system includes a control unit including a main output section arranged to output marine vessel maneuvering control information including starting information of the marine vessel propulsion device, and a sub output section arranged to output backup information including the starting information of the marine vessel propulsion device. The marine vessel control system further includes a first communication bus connected to the marine vessel propulsion device and the control unit and arranged to transmit the marine vessel maneuvering control information, output from the main output section, to the marine vessel propulsion device. The marine vessel control system further includes a second communication bus connected to the marine vessel propulsion device and the control unit and arranged to transmit the backup information, output from the sub output section, to the marine vessel propulsion device. The marine vessel control system further includes and an auxiliary device connection section provided in the second communication bus and arranged to enable connection of an auxiliary device that executes communication, related to auxiliary information other than the marine vessel maneuvering control information, with at least one of the marine vessel propulsion device and the control unit via the second communication bus.

The control unit is arranged to output the marine vessel maneuvering control information from the main output section to the first communication bus. The marine vessel propulsion device operates in accordance with the marine vessel maneuvering control information. The marine vessel maneuvering control information includes the starting information. The starting information specifically includes a starting command for starting the marine vessel propulsion device. The control unit outputs the backup information from the sub output section to the second communication bus, on the other hand. The backup information includes the starting information. Thus, even when a fault (disconnection, etc.) occurs in the first communication bus, the marine vessel propulsion device can be started based on the starting information from the second communication bus. Thus, at least, in regard to the starting of the marine vessel propulsion device, a dual system is arranged for communication between the control unit and the marine vessel propulsion device.

The second communication bus is provided with the auxiliary device connection section that enables connection of the auxiliary device. The auxiliary device can thus be connected to the second communication bus. The auxiliary device can thus perform the necessary communication with the control unit and the marine vessel propulsion device via the second communication bus.

The first communication bus is not provided with the auxiliary device connection section, and thus a communication load of the first communication bus is not increased due to communication by the auxiliary device. It thus suffices to determine a bus capacity of the first communication bus based on a maximum communication volume assumed for communication between the control unit and the marine vessel propulsion device.

When a fault is not occurring in the first communication bus, the marine vessel propulsion device can be controlled with excellent responsiveness because the marine vessel maneuvering control information can be transmitted at an adequate communication rate from the control unit to the marine vessel propulsion device. Satisfactory marine vessel maneuvering performance can thereby be secured. Also, even when a fault is not occurring in the first communication bus, the second communication bus can be used effectively for communication related to the auxiliary device, etc. The communication data and the communication paths flowing through the communication buses can thus be used efficiently.

When a fault occurs in the first communication bus, the marine vessel propulsion device operates in accordance with the backup information transmitted via the second communication bus. The backup information includes the starting information and the marine vessel propulsion device can thus be started. The marine vessel can thus be made to travel. With the backup information, when the auxiliary device is connected to the second communication bus, the responsiveness may be low due to the communication related to the auxiliary device. However, the minimum necessary functions for making the marine vessel travel are secured.

Efficient use can thus be made of the overall communication data volume flowing through the communication buses. Moreover, the communication for the auxiliary device is performed via the second communication bus that is used for transmission of the backup information and there is thus no need to provide a dedicated bus for the auxiliary device. The communication system can thus be made simple in arrangement to enable the trouble and time required for construction of the communication system to be reduced. Also, the auxiliary device and the marine vessel propulsion device are connected to the same bus, thereby enabling data to be communicated directly to each other, and there is no need to provide a data transfer process in the control unit. Processes of the control unit and paths for the communication data can thus be simplified.

A "marine vessel propulsion device" signifies a main propulsion device that applies a propulsive force in a forward drive direction to a hull. Also, "auxiliary device" refers to an equipment other than the marine vessel propulsion device. Auxiliary devices may be arranged to communicate with either or both of the control unit and the marine vessel propulsion device. An auxiliary propulsion device, such as a bow thruster arranged to provide a propulsive force in a right/left direction to the hull, is also an example of an auxiliary device.

Preferably, the auxiliary device is not connected to the first communication bus, and the auxiliary device is exclusively connected to the second communication bus. The first communication bus, which is used for basic marine vessel maneuvering functions, thus does not have to be reconfigured when the auxiliary device is attached subsequently. The influence of wiring work errors on the basic marine vessel maneuvering functions can thus be prevented. Also, the wiring work is made more readily understood by a worker because the communication bus (wiring) to which the auxiliary device is to be connected is unified to a single location.

Preferably, the sub output section is arranged to output the backup information that is lower in information volume per unit time than the marine vessel maneuvering control information output by the main output section. By this arrangement, the backup information and the information for the auxiliary device can be transmitted via the second communication bus without having to make the capacity of the second communication bus so high.

Specifically, the sub output section may be arranged to output the backup information at a communication cycle that is longer than a communication cycle at which the main output section outputs the marine vessel maneuvering control information.

In a preferred embodiment of the present invention, the marine vessel includes a plurality of the marine vessel propulsion devices, and each marine vessel propulsion device is connected to the first communication bus and the second communication bus.

By this arrangement, the plurality of marine vessel propulsion devices can receive the marine vessel maneuvering control information from the first communication bus and receive the backup information from the second communication bus. Thus, even when a fault occurs in the first communication bus, the respective marine vessel propulsion devices can be started based on the starting information included in the backup information transmitted via the second communication bus. The marine vessel propulsion devices that are started based on the starting information included in the backup information may be all or a portion of the plurality of marine vessel propulsion devices.

The sub output section may be arranged to transmit the backup information via the second communication bus only to a portion of the marine vessel propulsion devices among the plurality of marine vessel propulsion devices.

With this arrangement, the communication load of the second communication bus can be lightened because the sub output section outputs the backup information only to a portion of the marine vessel propulsion devices. The bus capacity of the second communication bus thus does not have to be made very large. Even when a fault occurs in the first communication bus, the marine vessel can be made to travel because at least a portion of the marine vessel propulsion device can be started based on the backup information.

The marine vessel control system may be used, for example, in a marine vessel in which an odd number of not less than three of the marine vessel propulsion devices are attached in alignment in a single row along the right/left direction of the hull. In this case, the sub output section may be arranged to output, as the backup information, a command for a single marine vessel propulsion device at a center.

Also, the marine vessel control system may be used, for example, in a marine vessel in which an even number of not less than four of the marine vessel propulsion devices are attached in alignment in a single row along the right/left direction of the hull. In this case, the sub output section may be arranged to output, as the backup information, a command for two marine vessel propulsion devices at the center.

Here, "center" signifies the center in the order of alignment of the plurality of marine vessel propulsion devices. Generally, when a plurality of marine vessel propulsion devices are attached in alignment in a single row along the right/left direction of the hull, the center in the order of alignment of the plurality of marine vessel propulsion devices is matched with the center of the hull in the right/left direction. When outboard motors are used as the marine vessel propulsion devices, the plurality of outboard motors are attached in alignment in a single row in the right/left direction at the stern.

By these arrangements, when a fault occurs in the first communication bus, the marine vessel can be made to travel by actuating the single or two marine vessel propulsion device or devices at the center. Moreover, the backup information does not include the commands for all of the marine vessel propulsion devices, and the information volume thereof is thus low. The second communication bus can thus be used in common for transmission of the backup information and communication for the auxiliary device without having to design the second communication bus to be large in capacity.

The marine vessel maneuvering control information (output of the main output section) that is to be effective when the first communication bus is normal may include the commands for all of the marine vessel propulsion devices.

A marine vessel propulsion device other than the single device or two devices at the center may be actuated when a fault occurs in the first communication bus. However, even in this case, the command included in the backup information is the command for the single or two marine vessel propulsion device or devices at the center, and thus the other marine vessel propulsion device is actuated according to the command for the marine vessel propulsion device or devices at the center.

Further, the marine vessel control system may be used in a marine vessel in which not less than three of the marine vessel propulsion devices are attached in alignment in a single row along the right/left direction of the hull. In this case, the sub output section may be arranged to output, as the backup information, a port-side command for the marine vessel propulsion device at a port-most side and a starboard-side command for the marine vessel propulsion device at a starboard-most side.

With this arrangement, the commands for the marine vessel propulsion devices at the port-most side and the starboard-most side are output as the backup information. Thus, even when a fault occurs in the first communication bus, at least, the marine vessel can be made to travel by actuating the marine vessel propulsion devices at the port-most side and the starboard-most side. Also, with the marine vessel in which the plurality of the marine vessel propulsion devices are installed, there is a case where the marine vessel is maneuvered by operating a marine vessel propulsion device at either the left or right in forward drive and operating a marine vessel propulsion device at the opposite side in reverse drive to rotate the marine vessel on the spot during launching from and docking on shore. In a case where the present arrangement is used, such a marine vessel maneuvering method is enabled even when a fault occurs in the first communication bus. Moreover, the backup information is low in information volume because it does not include the commands for all of the marine vessel propulsion devices. The second communication bus can thus be used in common for transmission of the backup information and communication for the auxiliary device without having to design the second communication bus to be large in capacity.

A marine vessel propulsion device other than the marine vessel propulsion devices at the port-most side and the starboard-most side may be actuated when a fault occurs in the first communication bus. However, even in this case, the commands included in the backup information are the commands for the marine vessel propulsion devices at the port-most side and the starboard-most side, and thus the other marine vessel propulsion device is actuated according to the command or commands for either or both of the marine vessel propulsion devices at the port-most side and the starboard-most side.

The number of the marine vessel propulsion devices may, for example, be three. In this case, the marine vessel propulsion device at the center may be arranged to operate based on the port-side command and the starboard-side command when a fault occurs in the first communication bus.

By this arrangement, even when a fault occurs in the first communication bus, not only the port-most side and the starboard-most side marine vessel propulsion devices but the marine vessel propulsion device at the center can also be actuated. A traveling state close to that when the first communication bus is normal can thereby be maintained. Moreover, the information volume of the backup information is not increased because the command for the marine vessel propulsion device at the center is not necessarily included in the backup information. The bus load of the second communication bus is thus not increased and a problem thus does not occur in the communication of the backup information and the information for the auxiliary device via the second communication bus.

The number of the marine vessel propulsion devices may, for example, be four. In this case, the marine vessel propulsion devices at a left side relative to the center may be arranged to operate based on the port-side command and the marine vessel propulsion devices at a right side relative to the center may be arranged to operate based on the starboard-side command when a fault occurs in the first communication bus.

By this arrangement, even when a fault occurs in the first communication bus, not only the port-most side and the starboard-most side marine vessel propulsion devices but all four marine vessel propulsion devices can be actuated. A traveling state close to that when the first communication bus is normal can thereby be maintained. Moreover, the information volume of the backup information is not increased because the commands for the two marine vessel propulsion devices near the center are not necessarily included in the backup information. The bus load of the second communication bus is thus not increased and a problem thus does not occur in the communication of the backup information and the information for the auxiliary device via the second communication bus.

The marine vessel control system may be used in a marine vessel in which five of the marine vessel propulsion devices are attached in alignment in a single row along the right/left direction of the hull. In this case, the sub output section may be arranged to output, as the backup information, a port-side command for the marine vessel propulsion device at the port-most side, a starboard-side command for the marine vessel propulsion device at the starboard-most side, and a central command for the marine vessel propulsion device at the center.

With this arrangement, the sub output section outputs the commands for three of the marine vessel propulsion devices as the backup information, and thus transmits, to the second communication bus, commands of lower information volume than the main output section. The bus load of the second communication bus can thereby lightened, and the second communication bus can thus be used in common for communication of the backup information and information for the auxiliary device without having to design the second communication bus to be large in capacity. Also, when a fault occurs in the first communication bus, at least the port-most side, starboard-most side, and central marine vessel propulsion devices can be actuated based on the backup information. The marine vessel can be made to travel thereby.

For example, when a fault occurs in the first communication bus, the marine vessel propulsion devices at the left side relative to the center may be arranged to operate based on the port-side command, the marine vessel propulsion devices at the right side relative to the center may be arranged to operate based on the starboard-side command, and the marine vessel propulsion device at the center may be arranged to operate based on the central command. By this arrangement, all five marine vessel propulsion devices can be actuated even when a fault occurs in the first communication bus. A traveling state close to that when the first communication bus is normal can thereby be maintained.

In a preferred embodiment of the present invention, the main output section is arranged to output marine vessel maneuvering control information for a portion of the marine vessel propulsion devices among the plurality of marine vessel propulsion devices, and the sub output section is arranged to output, as the backup information, commands to the marine vessel propulsion devices other than the marine vessel propulsion devices that are subject to the marine vessel maneuvering control information.

By this arrangement, the commands for all of the marine vessel propulsion devices are generated by the marine vessel maneuvering control information output by the main output section and the backup information output by the sub output section together. When a fault occurs in the second communication bus, only the commands for the portion of the marine vessel propulsion devices among the plurality of marine vessel propulsion devices are output. Also, when a fault occurs in the first communication bus, only the commands for the remaining marine vessel propulsion devices are output. Actuation of a portion of the marine vessel propulsion devices is thus enabled when a fault occurs in one of either of the first and second communication bus. However, the marine vessel propulsion devices other than this portion of the marine vessel propulsion devices may be actuated according to commands for this portion of the marine vessel propulsion devices. By this arrangement, a larger number (for example, all) of the marine vessel propulsion devices can be actuated.

In a case where the number of the plurality of marine vessel propulsion devices is not less than three, the main output section may be arranged to output the marine vessel maneuvering control information that includes a port-most-side command for the marine vessel propulsion device at the port-most side and a starboard-most-side command for the marine vessel propulsion device at the starboard-most side.

That is, the main output section outputs the port-most-side command and the starboard-most-side command, and the sub output section outputs the central command for the central marine vessel propulsion device. That is, only the port-most-side marine vessel propulsion device and the starboard-most-side marine vessel propulsion device are subject to the marine vessel maneuvering control information. Also, only the central marine vessel propulsion device is subject to the backup information. In this case, the central marine vessel propulsion device refers to the single marine vessel propulsion device at the center when the number of marine vessel propulsion devices is an odd number and refers to the two marine vessel propulsion devices at the center when the number of marine vessel propulsion devices is an even number.

When a fault occurs in the first communication bus, the central outboard motor is actuated according to the central command. Also, when a fault occurs in the second communication bus, the port-most-side marine vessel propulsion device and the starboard-most-side marine vessel propulsion device are actuated respectively according to the port-most-side command and the starboard-most-side command. Marine vessel propulsion devices at the left side relative to the center may be actuated according to the port-most-side command, and marine vessel propulsion devices at the right side relative to the center may be actuated according to the starboard-most-side command.

In a preferred embodiment of the present invention, the marine vessel includes a single main marine vessel maneuvering compartment and not less than one sub marine vessel maneuvering compartment, a plurality of the control units are provided respectively in the plurality of marine vessel maneuvering compartments, and the first communication bus and the second communication bus are connected to the plurality of control units. By this arrangement, the marine vessel propulsion device can be controlled from any of the marine vessel maneuvering compartments because the first and second communication buses are connected to the control units provided in the plurality of marine vessel maneuvering compartments.

Preferably, the control unit of the main marine vessel maneuvering compartment is arranged to output the backup information to the second communication bus, and the control unit of each sub marine vessel maneuvering compartment is arranged so as not to output the backup information.

By this arrangement, the communication load of the backup information can be lightened because the control unit of the sub marine vessel maneuvering compartment does not output the backup information. The backup information is output from the control unit of the main marine vessel maneuvering compartment, and marine vessel maneuvering can thus be performed from the main marine vessel maneuvering compartment even when a fault occurs in the first communication bus. The marine vessel can thereby be made to travel.

Preferably, the marine vessel control system further includes a switching unit that is arranged such that if marine vessel maneuvering is being performed at the sub marine vessel maneuvering compartment when a fault occurs in the first communication bus, the marine vessel propulsion device is controlled to stop the marine vessel and the compartment at which marine vessel maneuvering is performed is switched from the sub marine vessel maneuvering compartment to the main marine vessel maneuvering compartment.

The control unit of the sub marine vessel maneuvering compartment does not send the backup information and thus when a fault occurs in the first communication bus while marine vessel maneuvering is performed at the sub marine vessel maneuvering compartment, the marine vessel maneuvering cannot be continued. The marine vessel is thus stopped and the compartment at which the marine vessel maneuvering is performed is switched to the main marine vessel maneuvering compartment. At least one of the marine vessel propulsion devices can thereby be actuated based on the backup information output by the control unit of the main marine vessel maneuvering compartment, and the marine vessel can thus be made to travel.

A preferred embodiment of the present invention provides a marine vessel propulsion system that includes, a marine vessel propulsion device, a control unit, a first communication bus, a second communication bus, and an auxiliary device. The control unit includes a main output section arranged to output marine vessel maneuvering control information including starting information of the marine vessel propulsion device, and a sub output section arranged to output backup information including the starting information of the marine vessel propulsion device. The first communication bus is connected to the marine vessel propulsion device and the control unit, and is arranged to transmit the marine vessel maneuvering control information, output from the main output section, to the marine vessel propulsion device. The second communication bus is connected to the marine vessel propulsion device and the control unit, and is arranged to transmit the backup information, output from the sub output section, to the marine vessel propulsion device. The auxiliary device is connected to the second communication bus, and is arranged to execute communication, related to auxiliary information other than the marine vessel maneuvering control information, with at least one of the marine vessel propulsion device and the control unit via the second communication bus.

Also, a preferred embodiment of the present invention provides a marine vessel that includes a hull, a marine vessel propulsion device attached to the hull, a control unit, a first communication bus, a second communication bus, and an auxiliary device. The control unit includes a main output section arranged to output marine vessel maneuvering control information including starting information of the marine vessel propulsion device, and a sub output section arranged to output backup information including the starting information of the marine vessel propulsion device. The first communication bus is connected to the marine vessel propulsion device and the control unit, and is arranged to transmit the marine vessel maneuvering control information, output from the main output section, to the marine vessel propulsion device. The second communication bus is connected to the marine vessel propulsion device and the control unit, and is arranged to transmit the backup information, output from the sub output section, to the marine vessel propulsion device. The auxiliary device is connected to the second communication bus, and is arranged to execute communication, related to auxiliary information other than the marine vessel maneuvering control information, with at least one of the marine vessel propulsion device and the control unit via the second communication bus.

The same modifications as those of preferred embodiments of the present invention related to the marine vessel control system are possible in regard to preferred embodiments of the present invention of the marine vessel propulsion system and the marine vessel.

The marine vessel propulsion device may be in the form of an outboard motor, an inboard/outboard motor (a stern drive or an inboard motor/outboard drive), an inboard motor, a water jet drive, or other suitable motor or drive. The outboard motor includes a propulsion unit, provided outboard of the vessel and having a motor (engine or electric motor) and a propulsive force generating member (propeller), and a steering mechanism, which horizontally turns the entire propulsion unit with respect to the hull. The inboard/outboard motor includes a motor, disposed inboard of the vessel, and a drive unit, disposed outboard of the vessel and having a propulsive force generating member and a steering mechanism. The inboard motor includes a motor and a drive unit, both disposed inboard of the vessel, and a propeller shaft extending outboard from the drive unit. In this case, a steering mechanism is separately provided. The water jet drive is arranged such that water sucked from the hull bottom is accelerated by a pump and ejected from an ejection nozzle provided at the stern to provide a propulsive force. In this case, the steering mechanism is arranged from the ejection nozzle and a mechanism for rotating, in a horizontal plane, the direction of the water flow ejected from the ejection nozzle.

Other elements, features steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
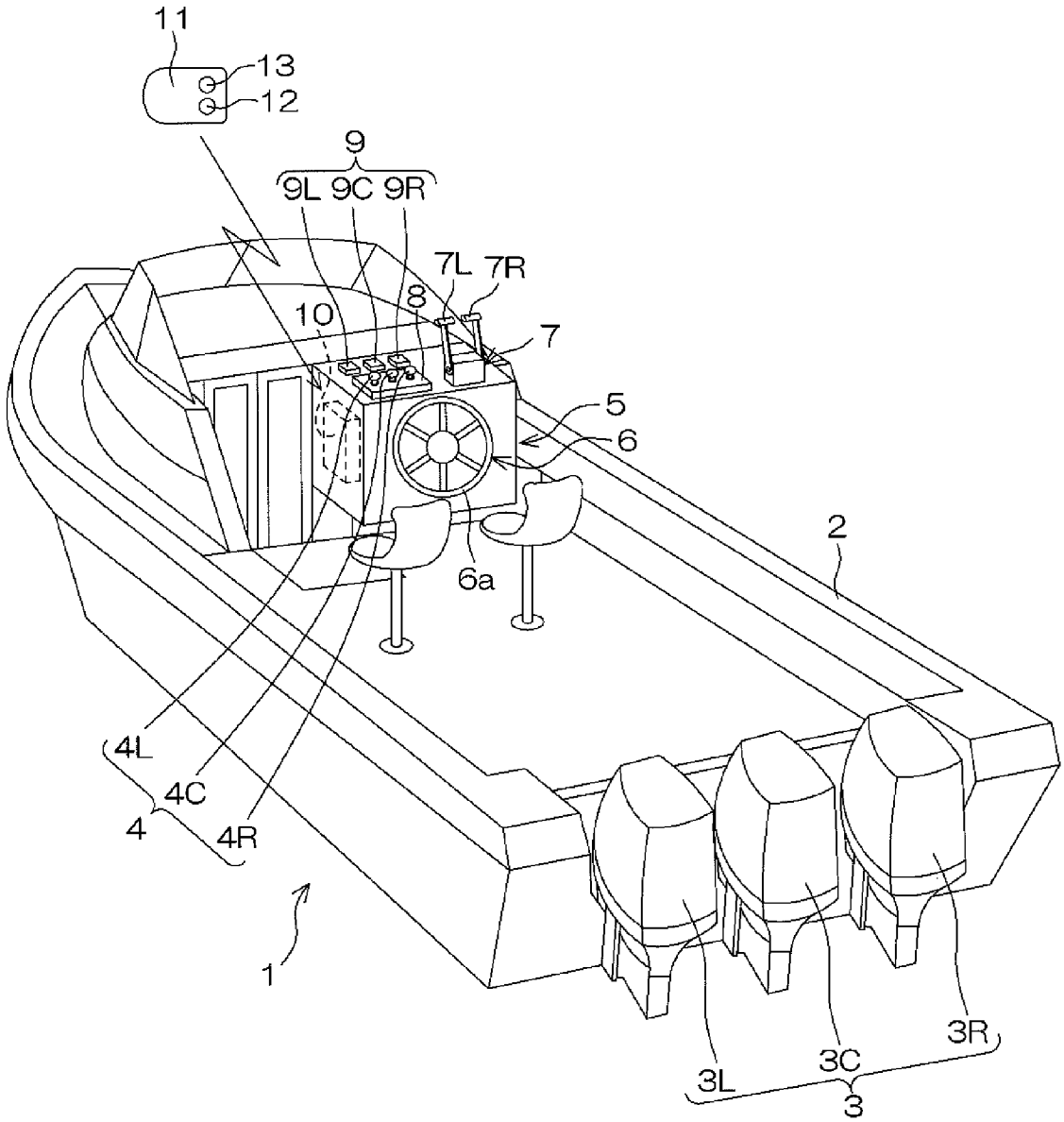
FIG. 1 is a perspective view for explaining an arrangement of a marine vessel according to a first preferred embodiment of the present invention.

FIG. 1 is a perspective view for explaining an arrangement of a marine vessel to which a marine vessel control system according to a first preferred embodiment of the present invention is applied. The marine vessel 1 includes a hull 2 and outboard motors 3 as marine vessel propulsion devices. A plurality (for example, three, in the preferred embodiment) of the outboard motors 3 are included. The outboard motors 3 are attached in alignment in a single row along a stern of the hull 2 (that is, along a right/left direction of the hull 2). When the three outboard motors are to be distinguished, that disposed at a starboard side shall be referred to as the "starboard-side outboard motor 3R," that disposed at a center shall be referred to as the "central outboard motor 3C," and that disposed at a port side shall be referred to as the "port-side outboard motor 3L." Each of the outboard motors 3 includes an engine (internal combustion engine) and generates a propulsive force by a propeller that is rotated by a driving force of the engine.

A marine vessel maneuvering compartment 5 is provided at a front section (stem side) of the hull 2. The marine vessel maneuvering compartment 5 includes a steering apparatus 6, a remote controller 7, an operation panel 8, and a gauge 9.

The steering apparatus 6 includes a steering handle 6*a* arranged to be rotatingly operated by a marine vessel operator. The operation of the steering handle 6*a* is detected by an operation angle sensor (not shown in FIG. 1) to be described below.

The remote controller 7 includes two levers, i.e., right and left levers 7R and 7L. Each of these levers 7R and 7L can be inclined forward and in reverse. Operation positions of the levers 7R and 7L are respectively detected by position sensors (not shown in FIG. 1) to be described below. The operation of the outboard motor 3 is controlled according to the detected operation positions. By inclining the levers 7R and 7L forward by not less than predetermined amounts from predetermined neutral positions, shift positions of the outboard motors 3 are set to forward drive positions and propulsive forces in forward drive directions are generated from the outboard motors 3. By inclining the levers 7R and 7L in reverse by not less than predetermined amounts from the predetermined neutral positions, the shift positions of the outboard motors 3 are set to reverse drive positions and propulsive forces in reverse drive directions are generated from the outboard motors 3. When the levers 7R and 7L are at the neutral positions, the shift positions of the outboard motors 3 are at neutral positions and the outboard motors 3 do not generate a propulsive force. Also, outputs of the outboard motors 3, that is, target engine rotational speeds (corresponding to target throttle opening degrees) of the engines included in the outboard motors 3, can be changed according to inclination amounts of the levers 7R and 7L.

The target engine rotational speed is set to an idling rotational speed up to the forward inclination position of the predetermined amount (forward drive shift-in position). When each of the levers 7R and 7L is inclined forward beyond the forward drive shift-in position, the target engine rotational speed is set higher as the lever inclination amount is greater. Also, the target engine rotational speed is set to an idling rotational speed up to the reverse inclination position of the predetermined amount (reverse drive shift-in position). When each of the levers 7R and 7L is inclined in reverse beyond the reverse drive shift-in position, the target engine rotational speed is set higher as the lever inclination amount is greater.

The shift position and the engine rotational speed of the starboard-side outboard motor 3R are in accordance with the operation position of the right lever 7R. The shift position and the engine rotational speed of the port-side outboard motor 3L are in accordance with the operation position of the left lever 7L. The shift position and the engine rotational speed of the central outboard motor 3C are in accordance with the operation positions of the right and left levers 7R and 7L. Specifically, when the shift positions corresponding to the operation positions of the right and left lever 7R and 7L are matched, the corresponding shift position is set as the target shift position of the central outboard motor 3C. In this case, the target engine rotational speed of the central outboard motor 3C may be set to an average value of the target engine rotational speeds of the starboard-side and port-side outboard motors 3R and 3L. When the shift positions corresponding to the operation positions of the right and left levers 7R and 7L are unmatched, the target shift position of the central outboard motor 3C is set to the neutral position. In this case, the target engine rotational speed of the central outboard motor 3C is set to the idling rotational speed.

The operation panel 8 includes three key switches 4R, 4C, and 4L ("key switch 4," when referred to collectively below) respectively corresponding to the three outboard motors 3R, 3C, and 3L.

The key switches 4R, 4C, and 4L are arranged to be operated to turn on and off power supplies to the outboard motors 3R, 3C, and 3L, respectively. Each of the key switches 4R, 4C, and 4L can be operated among an on position, an off position, and a starting position by insertion of a corresponding key in a key cylinder. The off position is an operation position at which the supply of power to the corresponding outboard motor 3 is interrupted. The on position is an operation position for turning on the power supply to the corresponding outboard motor 3. The starting position is an operation position for starting the engine of the corresponding outboard motor 3.

Three gauges 9 are included in correspondence to the three outboard motors 3. When these three gauges are to be distinguished, that corresponding to the starboard-side outboard motor 3R shall be referred to as the "starboard-side gauge 9R," that corresponding to the central outboard motor 3*c* shall be referred to as the "central gauge 9C," and that corresponding to the port-side outboard motor 3L shall be referred to as the "port-side gauge 9L." These gauges 9 display states of the corresponding outboard motors 3. Specifically, the on/off state of the power supply, the engine rotational speed, and other previously determined information of the corresponding outboard motor 3 are displayed.

The marine vessel maneuvering compartment 5 also includes an immobilizer 10 (receiver). The immobilizer 10 receives signals from a key unit 11 carried by a user of the marine vessel 1 and is a device that allows ordinary use of the marine vessel 1 only to a legitimate user. The key unit 11 includes a lock button 12 and an unlock button 13. The lock button 12 is a button that is operated to set the immobilizer 10 in a locked state. By operation of the lock button 12, a lock signal is sent from the key unit 11. When the immobilizer 10 is set in the locked state, the marine vessel 1 is put in a state in which ordinary use is prohibited. The unlock button 13 is a button that is operated to release the locked state and set the immobilizer 10 in an unlocked state to start ordinary use of the marine vessel 1. By operation of the unlock button 13, an unlock signal is sent from the key unit 11. The key unit 11 sends a user authentication code along with the lock signal and the unlock signal.

The immobilizer 10 receives the user authentication code from the key unit 11 and executes a user authentication process. That is, the immobilizer 10 checks matching or non-matching with collation source data that are registered in advance. If the user authentication process succeeds, the immobilizer 10 accepts the lock signal and the unlock signal from the key unit 11. If the user authentication process fails, the immobilizer 10 becomes unresponsive to the lock signal and the unlock signal from the key unit 11.

Figure 2:
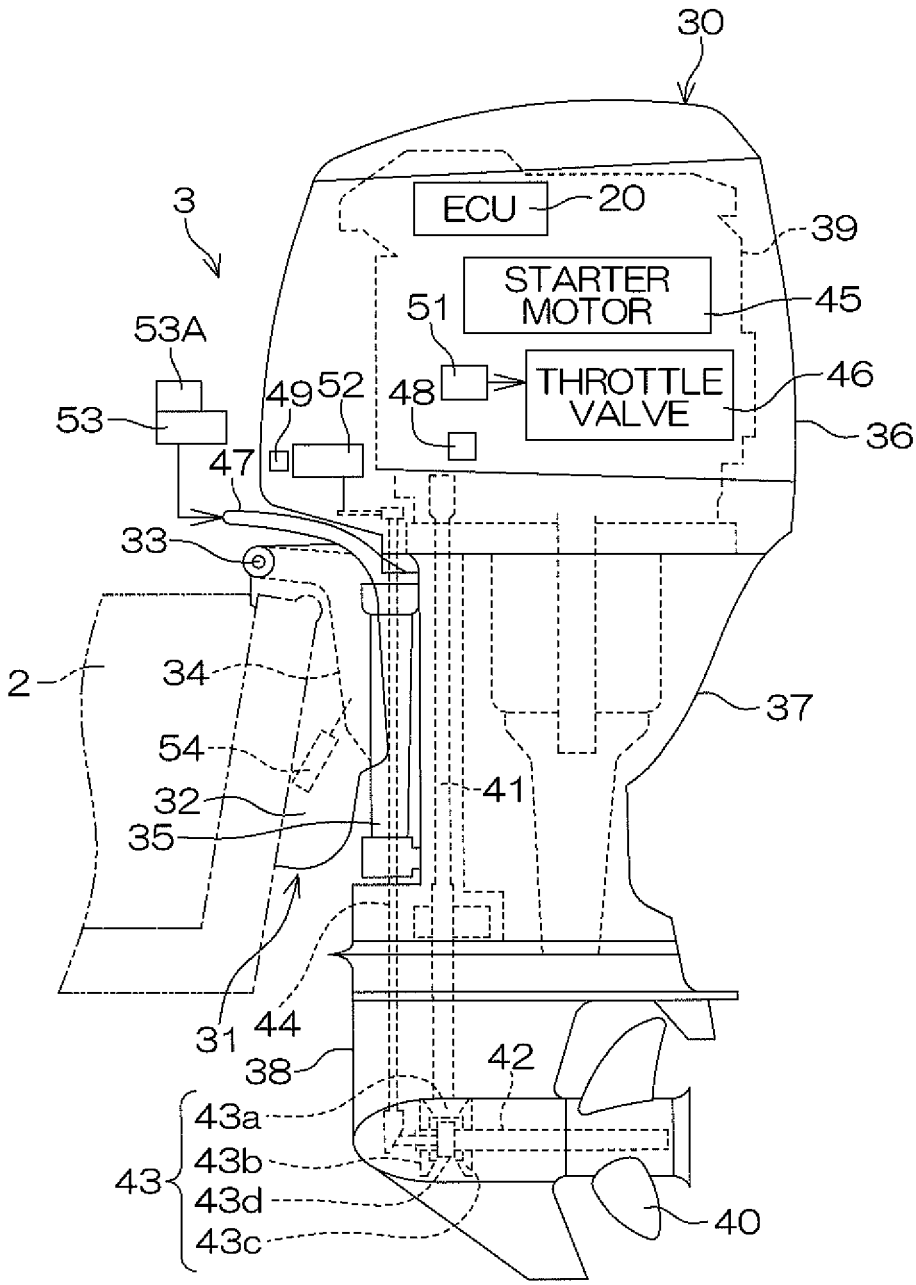
FIG. 2 is a diagram for explaining an arrangement example of an outboard motor.

FIG. 2 is a diagram for explaining an arrangement example in common to the three outboard motors 3. Each outboard motor 3 includes a propulsion unit 30 and an attachment mechanism 31 for attaching the propulsion unit 30 to the hull 2. The attachment mechanism 31 includes a clamp bracket 32 detachably fixed to a tail plate of the hull 2, and a swivel bracket 34 coupled to the clamp bracket 32 in a manner enabling rotation about a tilt shaft 33 as a horizontal rotational axis. The propulsion unit 30 is attached to the swivel bracket 34 in a manner enabling rotation about a steering shaft 35. A steering angle (azimuth angle defined by the direction of the propulsive force with respect to a center line of the hull 2) can thus be changed by rotating the propulsion unit 30 about the steering shaft 35. Also, a trim angle of the propulsion unit 30 can be changed by rotating the swivel bracket 34 about the tilt shaft 33. The trim angle corresponds to an angle of attachment of the outboard motor 3 with respect to the hull 2.

A housing of the propulsion unit 30 includes an engine cover (top cowling) 36, an upper case 37, and a lower case 38. Inside the engine cover 36, the engine 39, which is to be a drive source, is installed with an axis of a crankshaft thereof extending vertically. A driveshaft 41 for power transmission is coupled to a lower end of the crankshaft of the engine 39 and extends vertically through the upper case 37 into the lower case 38.

A propeller 40 is rotatably attached as a propulsive force generating member to a lower rear portion of the lower case 38. A propeller shaft 42, which is a rotation shaft of the propeller 40, extends horizontally in the lower case 38. The rotation of the driveshaft 41 is transmitted to the propeller shaft 42 via a shift mechanism 43 as a clutch mechanism.

The shift mechanism 43 includes a drive gear 43*a*, arranged from a beveled gear fixed to a lower end of the drive shaft 41, a forward drive gear 43*b*, arranged from a beveled gear rotatably disposed on the propeller shaft 42, a reverse drive gear 43*c*, arranged from a beveled gear likewise rotatably disposed on the propeller shaft 42, and a dog clutch 43*d*, disposed between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a reverse side. The forward drive gear 43*b* and the reverse drive gear 43*c* thus rotate in mutually opposite directions.

The dog clutch 43*d* is in spline engagement with the propeller shaft 42. That is, the dog clutch 43*d* can slide with respect to the propeller shaft 42 in the axial direction of the shaft but is not rotatable relative to the propeller shaft 42 and rotates together with the propeller shaft 42.

The dog clutch 43*d* is caused to slide on the propeller shaft 42 by axial rotation of a shift rod 44 that extends vertically and in parallel to the drive shaft 41. The dog clutch 43*d* is thereby controlled to be set at a shift position among a forward drive position of engagement with the forward drive gear 43*b*, a reverse drive position of engagement with the reverse drive gear 43*c*, and a neutral position of not being engaged with either the forward drive gear 43*b* or the reverse drive gear 43*c*.

When the dog clutch 43*d* is at the forward drive position, the rotation of the forward drive gear 43*b* is transmitted to the propeller shaft 42 via the dog clutch 43*d*. The propeller 40 is thereby rotated in one direction (forward drive direction) to generate a propulsive force in a direction for moving the hull 2 forward. On the other hand, when the dog clutch 43*d* is at the reverse drive position, the rotation of the reverse drive gear 43*c* is transmitted to the propeller shaft 42 via the dog clutch 43*d*. The reverse drive gear 43*c* is rotated in a direction opposite that of the forward drive gear 43*b*, and the propeller 40 is thus rotated in an opposite direction (reverse drive direction) to generate a propulsive force in a direction for moving the hull 2 in reverse. When the dog clutch 43*d* is in the neutral position, the rotation of the drive shaft 41 is not transmitted to the propeller shaft 42. That is, a driving force transmission path between the engine 39 and the propeller 40 is interrupted, so that a propulsive force is not generated in any direction.

In relation to the engine 39, a starter motor 45 arranged to start the engine 39 is disposed. The starter motor 45 is controlled by an outboard motor ECU (electronic control unit) 20. A throttle actuator 51 is also arranged to actuate a throttle valve 46 of the engine 39 in order to change a throttle opening degree to change an intake air amount of the engine 39. The throttle actuator 51 may include an electric motor. Operation of the throttle actuator 51 is controlled by the outboard motor ECU 20. The engine 39 further includes an engine rotational speed detecting section 48 arranged to detect a rotational speed of the engine 39 by detecting the rotation of the crankshaft.

Also, in relation to the shift rod 44, a shift actuator 52 (clutch actuator) arranged to change the shift position of the dog clutch 43*d* is provided. The shift actuator 52 includes, for example, an electric motor, and its operation is controlled by the outboard motor ECU 20. In relation to the shift actuator 52, a shift position sensor 49 arranged to detect the shift position of the shift mechanism 43 is provided.

Further, a steering mechanism 53, which is driven in accordance with operation of the steering apparatus 6 (see FIG. 1), is coupled to a steering rod 47 fixed to the propulsion unit 30. By the steering mechanism 53, the propulsion unit 30 is rotated about the steering shaft 35 and the steering operation can be performed thereby. The steering mechanism 53 includes a steering actuator 53A. The steering actuator 53A is controlled by the outboard motor ECU 20. The steering actuator 53A may include an electric motor or a hydraulic actuator, for example.

Also, a tilt/trim actuator 54, which includes, for example, a hydraulic cylinder and is controlled by the outboard motor ECU 20, is provided between the clamp bracket 32 and the swivel bracket 34. The tilt/trim actuator 54 rotates the propulsion unit 30 about the tilt shaft 33 by rotating the swivel bracket 34 about the tilt shaft 33.

Figure 3:
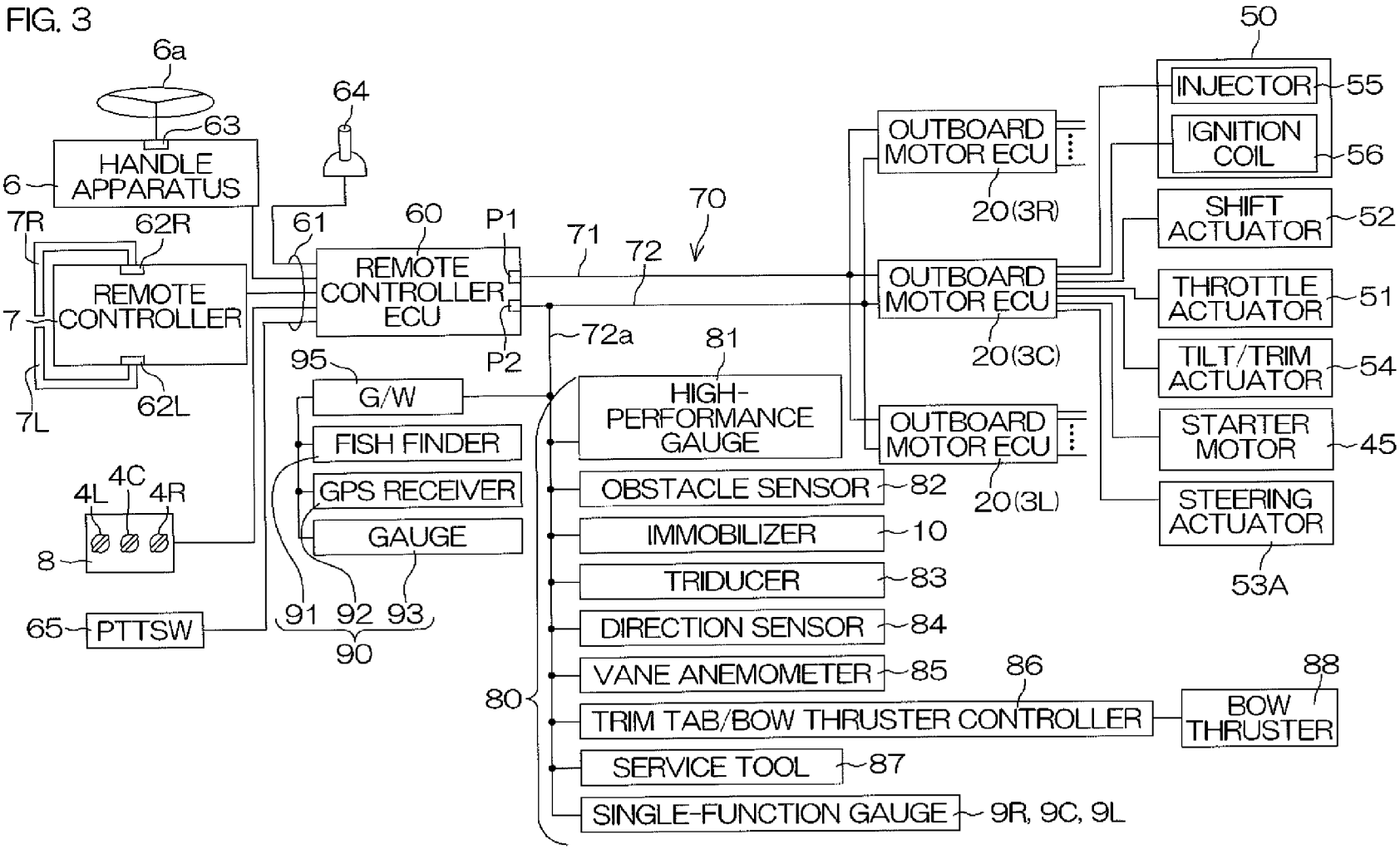
FIG. 3 is a diagram for explaining an electrical arrangement of a marine vessel control system.

FIG. 3 is a diagram for explaining an electrical arrangement of the marine vessel control system included in the marine vessel 1.

The remote controller 7 is connected via an analog signal line 61 to a remote controller ECU (electronic control unit) 60. More specifically, the remote controller 7 includes position sensors 62R and 62L that detect operation positions of the right and left remote control levers 7R and 7L. Output signals of the position sensors 62R and 62L are input into the remote controller ECU 60. Also, signals from the operation panel 8 are input into the remote controller ECU 60. Further, the steering apparatus 6 is connected to the remote controller ECU 60. Specifically, an output signal of the operation angle sensor 63 that detects the operation angle of the steering handle 6*a* is input into the remote controller ECU 60. Further, other operation apparatuses, such as a joystick 64, a power tilt/trim switch (PTTSW) 65, etc., may be connected as necessary to the remote controller ECU 60. The remote controller ECU 60 has a microcomputer incorporated therein and generates control commands for controlling the outboard motors 3R, 3C, and 3L according to the input signals.

Each of the outboard motors 3R, 3C, and 3L includes the outboard motor ECU 20. An engine unit 50 (more specifically, an injector 55 and an ignition coil 56), the shift actuator 52, the throttle actuator 51, the tilt/trim actuator 54, the starter motor 45, and the steering actuator 53A are connected to the outboard motor ECU 20 as controlled objects. These controlled objects may be referred to hereinafter as "actuators."

The outboard motor ECU 20 has a microcomputer incorporated therein and controls the actuators in accordance with commands provided from the remote controller ECU 60. Only the actuators (controlled objects), which are controlled by the outboard motor ECU 20 corresponding to the central outboard motor 3C, are shown in FIG. 3. The same actuators included in the starboard-side outboard motor 3R and the port-side outboard motor 3L are respectively controlled by the corresponding outboard motor ECUs 20.

The remote controller ECU 60 and the outboard motor ECUs 20 of the outboard motors 3R, 3C, and 3L communicate via a CAN (control area network) 70 constructed inside the marine vessel 1. The CAN 70 includes a first communication bus 71 and a second communication bus 72 that include CAN cables. The first communication bus 71 is preferably used exclusively for communication of the remote controller ECU 60 and the outboard motor ECU 20. The second communication bus 72 is preferably used for communication of the remote controller ECU 60 and the outboard motor ECU 20 and is also preferably used for communication of information (hereinafter referred to as "auxiliary information") for an auxiliary device for extending functions of the marine vessel 1.

The remote controller ECU 60 is connected to the first communication bus 71 and the second communication bus 72. More specifically, the remote controller ECU 60 has a first port P1 (input/output section) as a main output section and a second port P2 (input/output section) as a sub output section. The first communication bus 71 is connected to the first port P1, and the second communication bus 72 is connected to the second port P2.

The first and second communication buses 71 and 72 are connected to all of the outboard motors 3R, 3C, and 3L. That is, the first and second communication buses 71 and 72 are connected to the respective outboard motor ECUs 20 of all of the outboard motors 3R, 3C, and 3L. The outboard motor ECUs 20 of the respective outboard motors 3R, 3C, and 3L can thus perform communication with the remote controller ECU 60 via the first communication bus 71 and the second communication bus 72.

The remote controller ECU 60 outputs control commands upon designating an outboard motor ECU 20 that is to be a communication destination. The designated outboard motor ECU 20 receives the control commands and controls the actuators in accordance with the control commands. However, the outboard motor ECU 20 can also take in control commands, sent with the outboard motor ECU 20 of another outboard motor as a destination, and use the commands for control of the actuators.

The remote controller ECU 60 sends the control commands for control of the outboard motor 3 to the first port P1 and the second port P2. In the following, the control commands that the remote controller ECU 60 sends out from the first port P1 shall be referred to as "marine vessel maneuvering control information," and the control commands that the remote controller ECU 60 sends out from the second port P2 shall be referred to as "backup information." The marine vessel maneuvering control information includes starting information, the target engine rotational speed, the target shift position, and the target steering angle. In addition, the marine vessel maneuvering control information may include a tilt command and a trim command. The backup information includes the starting information, the target engine rotational speed, the target shift position, and the target steering angle. In addition, the backup information may include a tilt command and a trim command. The starting information includes a starting command for starting the engine of the outboard motor 3.

The starting command is output when the key switch 4 is operated to the starting position. In response to the starting command, the outboard motor ECU 20 drives the starter motor 45 and starts control (fuel injection control) of the injector 55 and control (ignition control) of the ignition coil 56. The target engine rotational speed is a target value of the rotational speed of the engine 39 of the outboard motor 3. The outboard motor ECU 20 controls the throttle actuator 51 according to the target engine rotational speed. The target shift position is a command value related to the shift position of the shift mechanism 43. The outboard motor ECU 20 controls the shift actuator 52 in accordance with the target shift position. The target steering angle is a target value of the azimuth angle of the outboard motor 3 with respect to the hull 2. Ordinarily, a target steering angle that is in accordance with the operation angle of the steering handle 6*a* is generated. The outboard motor ECU 20 controls the steering actuator 53A in accordance with the target steering angle. The tilt command and the trim command are generated in response to the operation of the power tilt/trim switch 65. The tilt command is a command for raising the propeller 40 of the outboard motor 3 onto a water surface or immersing the propeller in water. The trim command is a command for changing a depression/elevation angle of the outboard motor 3 with respect to the hull 2. The outboard motor ECU 20 controls the tilt/trim actuator 54 according to the tilt command and the trim command.

One or more auxiliary device connection sections 72*a*, each connectable to an auxiliary device, are included in the second communication bus 72. Each auxiliary device connection section 72*a* may be an auxiliary communication bus that is branched from the second communication bus 72. In the example of FIG. 3, a plurality of auxiliary devices 80 are connected to the second communication bus 72. The auxiliary devices 80 can perform sending and receiving of auxiliary information with either or both of the remote controller ECU 60 and the outboard motor ECU 20 via the second communication bus 72. A high-performance gauge 81, an obstacle sensor 82, the immobilizer (receiver) 10, a triducer (marine vessel speed/water depth/water temperature sensor) 83, a direction sensor 84, a vane anemometer 85, a trim tab/bow thruster controller 86, a service tool 87, a bow thruster 88, and the single-function gauges 9R, 9C, and 9L can be cited as examples of the auxiliary devices 80. The bow thruster 88 is controlled by the trim tab/bow thruster controller 86. The bow thruster is an auxiliary propulsion device that generates a propulsive force in the right/left direction of the hull. Such an auxiliary propulsion device is also an example of an auxiliary device.

Also, auxiliary devices (third-party equipments) 90 that differ in communication protocol can be connected to the second communication bus 72 via a gateway (G/W) 95. That is, the auxiliary devices 90 can perform sending and receiving of auxiliary information with either or both of the remote controller ECU 60 and the outboard motor ECU 20 via the gateway 95 and the second communication bus 72. A fish finder 91, a GPS receiver 92, and a gauge 93 can be cited as examples of such auxiliary devices 90.

For example, the gauges 9R, 9C, 9L, and 93 may receive engine rotational speed information from the outboard motor ECUs 20 and display the information. The service tool 87 may be a personal computer with a predetermined tool (computer program) for maintenance installed therein. The auxiliary devices 80 and 90 include those that only transmit information, those that only receive information, and those that transmit and receive information. Selection of the auxiliary devices to be connected is left up to the user. A boat builder connects the necessary auxiliary devices to the second communication bus 72 in accordance with the selection of the user.

The outboard motor ECU 20 may have a fault detection function for detecting a fault (mainly, disconnection) of the first communication bus 71. The outboard motor ECU 20 may be programmed in advance to execute different operations according to a normal state in which a fault is not occurring in the first communication bus 71 and a fault state in which a fault occurs in the first communication bus 71.

1-1. First Control Example

Figure 4:
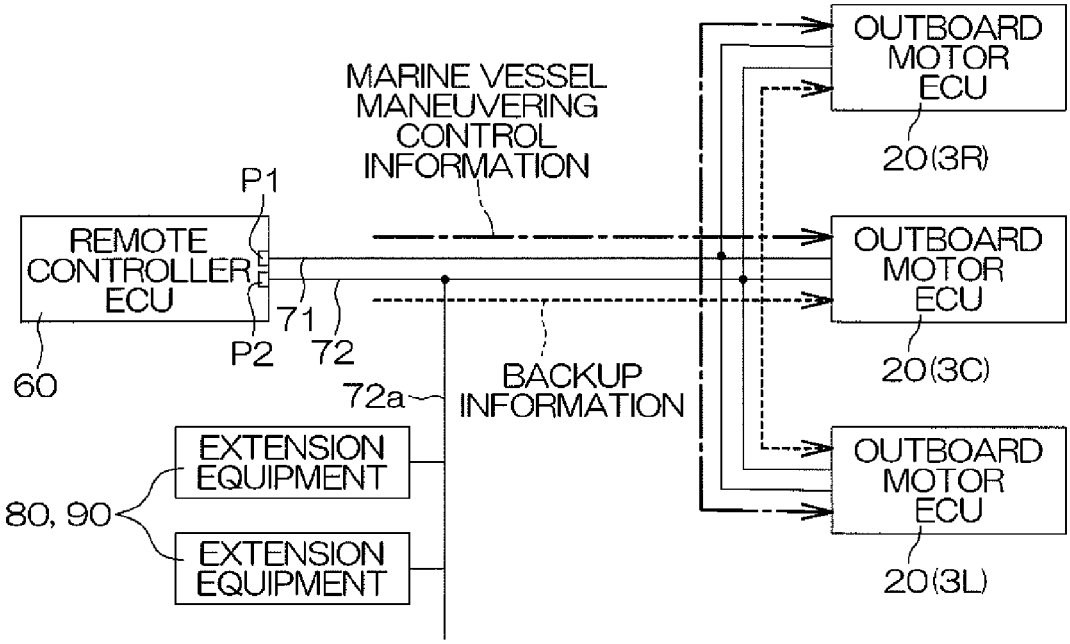
FIG. 4 is a schematic block diagram for explaining a first control example applicable to the first preferred embodiment of the present invention.

FIG. 4 is a schematic block diagram for explaining a first control example applicable to the present preferred embodiment. The remote controller ECU 60 sends out the marine vessel maneuvering control information to the first port P1 at a predetermined first cycle, and sends out the backup information to the second port P2 at a predetermined second cycle. The second cycle is set longer than the first cycle. The marine vessel maneuvering control information is thus sent to the first communication bus 71 at the first cycle, and the backup information is sent to the second communication bus 72 at the second cycle that is longer than the first cycle. An information volume per unit time of the backup information sent to the second communication bus 72 is thus less than the information volume per unit time of the marine vessel maneuvering control information sent to the first communication bus 71. The communication load of the second communication bus 72 is lightened accordingly. However, the auxiliary devices 80 and 90 are connected to the second communication bus 72, and the auxiliary information related to the auxiliary devices 80 and 90 are transmitted via the second communication bus 72.

The outboard motor ECUs 20 of the respective outboard motors 3 monitor the occurrence/non-occurrence of a fault of the first communication bus 71. In the normal state in which a fault is not occurring in the first communication bus 71, the respective outboard motor ECUs 20 control the actuators (controlled objects) based on the marine vessel maneuvering control information sent via the first communication bus 71. On the other hand, if it is determined that a fault is occurring in the first communication bus 71, the outboard motor ECUs 20 control the actuators in accordance with the backup information sent via the second communication bus 72. The outboard motor ECUs 20 can thus receive the control commands from the remote controller ECU 60 via the second communication bus 72 even when a fault occurs in the first communication bus 71.

The control commands provided via the second communication bus 72 are renewed at each second cycle, and responsiveness of control thus becomes poor in comparison to the normal state. However, control of the outboard motors 3 by the remote controller ECU 60 is enabled in this state and the marine vessel 1 can be made to travel by operation of the outboard motors 3.

The first communication bus 71 is used exclusively for the transmission of the marine vessel maneuvering control information. It thus suffices to design a bus capacity that can accommodate a maximum communication volume assumed on a maximum number of remote controller ECUs 60 (number of marine vessel maneuvering compartments) and a maximum number of outboard motor ECUs 20 (number of outboard motors 3) that can be connected. That is, there is no need to design the bus capacity assuming the transmission of the auxiliary information for the auxiliary devices 80 and 90.

On the other hand, the second communication bus 72 is preferably used for the transmission of the backup information and the transmission of the auxiliary information for the auxiliary devices 80 and 90. However, the sending cycle of the backup information is long and the communication load for the transmission of the backup information is suppressed. There is thus no need to perform design assuming communication of high capacity.

The communication data volumes of the first and second communication buses 71 and 72 can thus be used efficiently, and both the first and second communication buses 71 and 72 can be made to have the minimum necessary bus capacities. Also, the information volume of the backup information transmitted via the second communication bus 72 is suppressed, and there is thus no need to provide dedicated communication buses for the auxiliary devices 80 and 90. Instead, the second communication bus can be used in common for the transmission of the auxiliary information. The CAN 70 can thus be made simple in arrangement and the trouble and time required for outfitting or rigging the marine vessel with the marine vessel control system can be reduced.

In the first control example, the outboard motor ECUs 20 of the respective outboard motors 3 may be arranged not to monitor the occurrence/non-occurrence of a fault of the first communication bus 71. The normal state in which a fault is not occurring in the first communication bus 71 is a state where the respective outboard motors ECUs 20 can receive information from either of the communication buses of the first communication bus and the second communication bus. In this state, the respective outboard motor ECUs 20 control the actuators (controlled objects) based on the marine vessel maneuvering control information, which is sent via the first communication bus 71 and is practically short in transmission cycle. On the other hand, a state in which a fault is occurring in the first communication bus 71 is a state in which the respective outboard motor ECUs 20 can acquire information from only the second communication bus. In this state, the outboard motor ECUs 20 control the actuators according to the backup information sent via the second communication bus 72. Thus, even if fault detection is not performed, the outboard motors ECU 20 can receive the control commands from the remote controller ECU 60 via the second communication bus 72 when a fault occurs in the first communication bus 71.

1-2. Second Control Example

Figure 5:
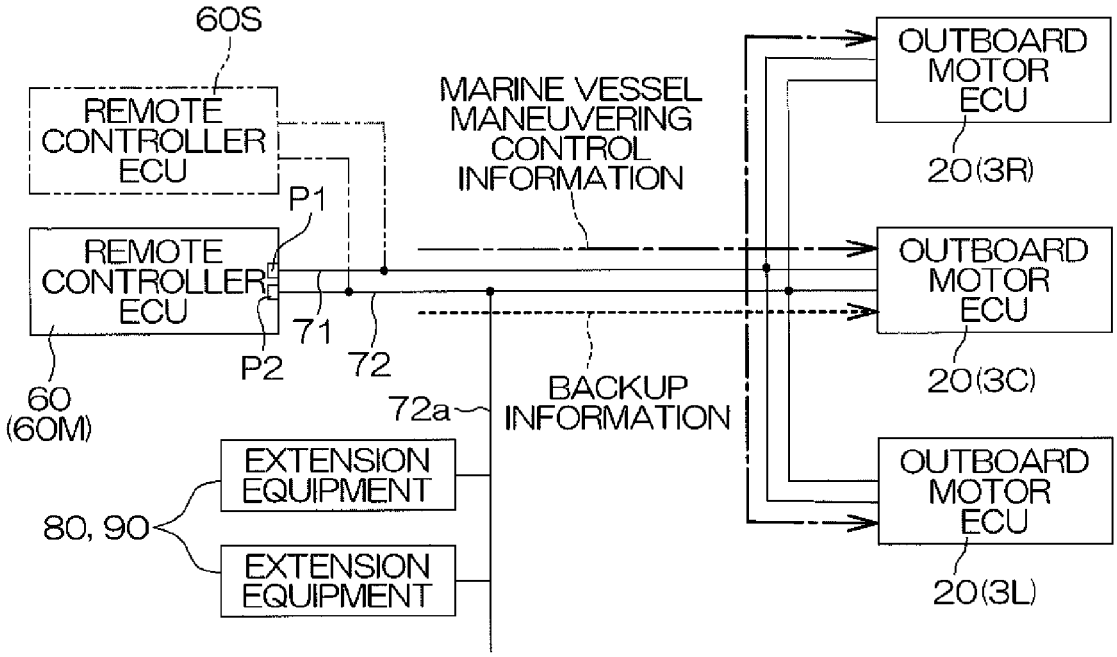
FIG. 5 is a schematic block diagram for explaining a second control example applicable to the first preferred embodiment of the present invention.

FIG. 5 is a schematic block diagram for explaining a second control example applicable to the present preferred embodiment. The remote controller ECU 60 sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information.

The outboard motor ECUs 20 of the respective outboard motors 3 monitor the occurrence/non-occurrence of a fault of the first communication bus 71. In the normal state in which a fault is not occurring in the first communication bus 71, the respective outboard motor ECUs 20 control the actuators based on the marine vessel maneuvering control information sent via the first communication bus 71. On the other hand, if it is determined that a fault is occurring in the first communication bus 71, the outboard motor ECUs 20 control the actuators in accordance with the backup information sent via the second communication bus 72.

The marine vessel maneuvering control information includes the control commands for all of the outboard motors 3R, 3C, and 3L. In contrast, the backup information includes only the control commands for a portion of the outboard motors 3. The information volume per unit time of the backup information is thus less than the information volume per unit time of the marine vessel maneuvering control information.

More specifically, the backup information may include only the control commands for the central outboard motor 3C. Thus, when a fault occurs in the first communication bus 71, operations of the port-side outboard motor 3L and the starboard-side outboard motor 3R are stopped and only the central outboard motor 3C is operable. The marine vessel 1 can thus be made to travel, albeit in a mode that is more restricted than the ordinary state.

Alternatively, the backup information may include only the control commands for the port-side outboard motor 3L and the starboard-side outboard motor 3R and not include the control commands for the central outboard motor 3C. In this case, when a fault occurs in the first communication bus 71, the operation of the central outboard motor 3C is stopped and only the port-side outboard motor 3L and the starboard-side outboard motor 3R are operable. The marine vessel 1 can thus be made to travel, albeit in a mode that is more restricted than the ordinary state.

The same effects as the first control example can thus be realized.

When a fault occurs in the first communication bus 71, operation of the engine at the idling rotational speed may be performed instead of stopping of operation at the outboard motor for which the control commands are not included in the backup information. In this case, the shift position is preferably controlled to be the neutral position.

1-3. Third Control Example

Figure 6:
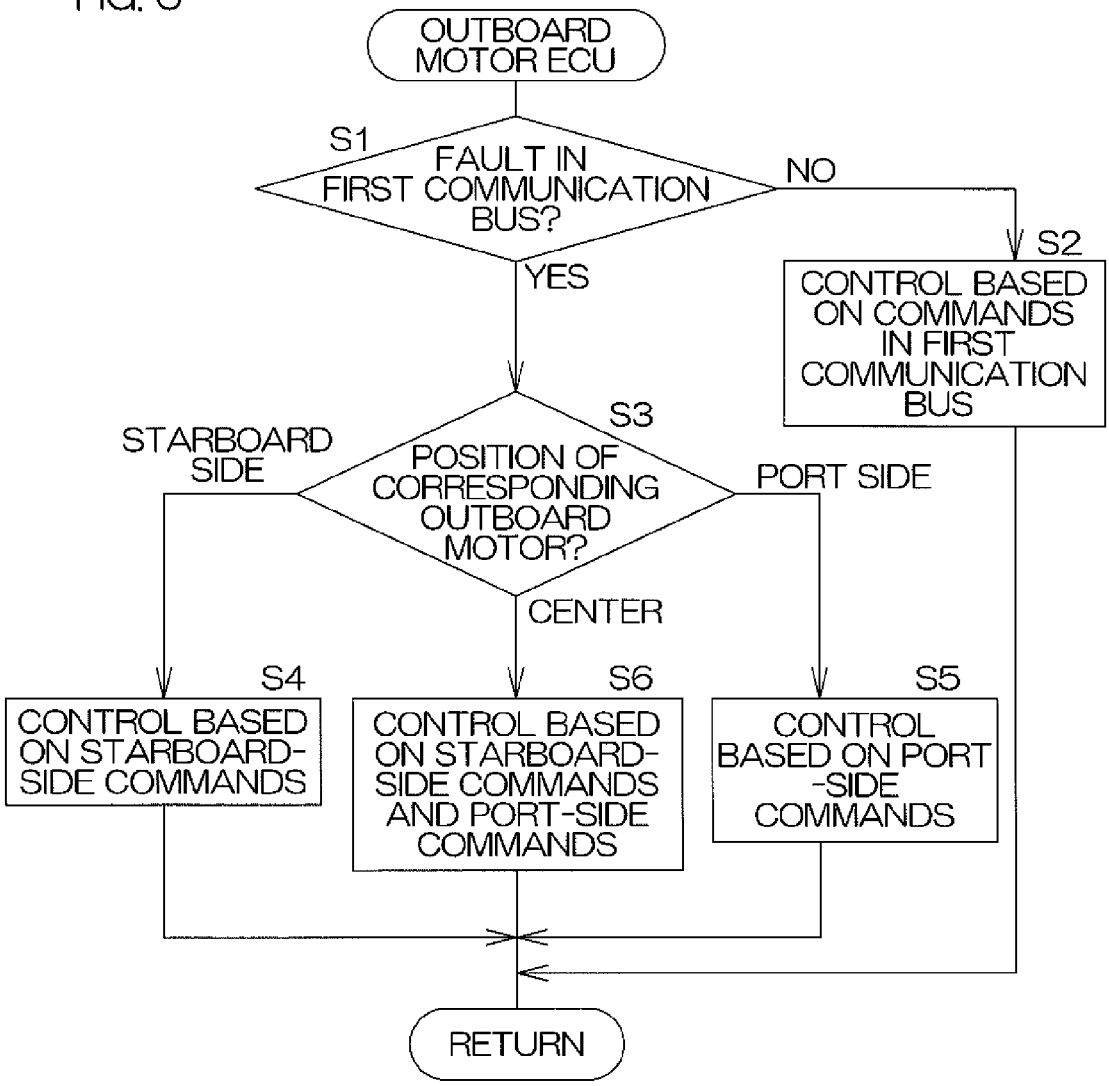
FIG. 6 is a flowchart for explaining a third control example applicable to the first preferred embodiment of the present invention.

FIG. 6 is a flowchart for explaining a third control example applicable to the first preferred embodiment and shows a process executed in the outboard motor ECU 20 of each outboard motor 3. FIG. 5 shall be referred to again in the description of the present control example. In the present control example, the remote controller ECU 60 sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information. In the present control example, the backup information includes the control commands for the starboard-side outboard motor 3R and the control commands for the port-side outboard motor 3L and does not include the control commands for the central outboard motor 3C. The outboard motor ECUs 20 of the respective outboard motors 3 monitor the occurrence/non-occurrence of a fault of the first communication bus 71 (step S1). In the normal state in which a fault is not occurring in the first communication bus 71 (step S1: NO), the respective outboard motor ECUs 20 control the actuators based on the marine vessel maneuvering control information sent via the first communication bus 71 (step S2). On the other hand, if it is determined that a fault is occurring in the first communication bus 71 (step S1: YES), each outboard motor ECU 20 determines the position of the corresponding outboard motor 3 (step S3). That is, the outboard motor ECU 20 holds, in an internal memory (not shown), outboard motor identification data indicating which of the starboard-side outboard motor 3R, the central motor 3C, and the port-side outboard motor 3L is corresponding to the outboard ECU 20. The outboard motor ECU 20 reads the outboard motor identification data to determine the position of the corresponding outboard motor. If the corresponding outboard motor is the starboard-side outboard motor 3R, the outboard motor ECU 20 controls the actuators of the starboard-side outboard motor 3R based on starboard-side outboard motor control commands (starboard-side commands) included in the backup information sent via the second communication bus 72 (step S4). Also, if the corresponding outboard motor is the port-side outboard motor 3L, the outboard motor ECU 20 controls the actuators of the port-side outboard motor 3L based on port-side outboard motor control commands (port-side commands) included in the backup information sent via the second communication bus 72 (step S5).

If the corresponding outboard motor is the central outboard motor 3C, the outboard motor ECU 20 controls the actuators of the central outboard motor 3C based on the starboard-side commands and the port-side commands included in the backup information sent via the second communication bus 72 (step S6).

An example of control of the central outboard motor 3C based on the starboard-side commands and the port-side commands shall now be described. In a case where the target shift positions included in the starboard-side commands and the port-side commands are both the forward drive position, the target shift position of the central outboard motor 3C is set to the forward drive position. In a case where the target shift positions included in the starboard-side commands and the port-side commands are both the reverse drive position, the target shift position of the central outboard motor 3C is set to the reverse drive position. In a case where the target shift positions included in the starboard-side commands and the port-side commands are both the neutral position, the target shift position of the central outboard motor 3C is set to the neutral position. If the target shift positions included in the starboard-side commands and the port-side commands are unmatched, the target shift position of the central outboard motor 3C is set to the neutral position. In the case where the target shift position of the central outboard motor 3C is set to the neutral position, the target engine rotational speed of the central outboard motor 3C is set to the idling rotational speed. If the target shift position of the central outboard motor 3C is set to the forward drive position or the reverse drive position, the target engine rotational speed of the central outboard motor 3C is set to an average value of the target engine rotational speeds included in the starboard-side commands and the port-side commands. The target steering angle of the central outboard motor 3C is set to zero degrees. That is, the central outboard motor 3C is maintained in a neutral orientation without declination to the right or the left.

The central outboard motor 3C can thus be controlled based on the starboard-side commands and the port-side commands. The marine vessel 1 can thereby be made to travel while continuing operations of all of the outboard motors 3 even when a fault occurs in the first communication bus 71.

1-4. Fourth Control Example

Figure 7:
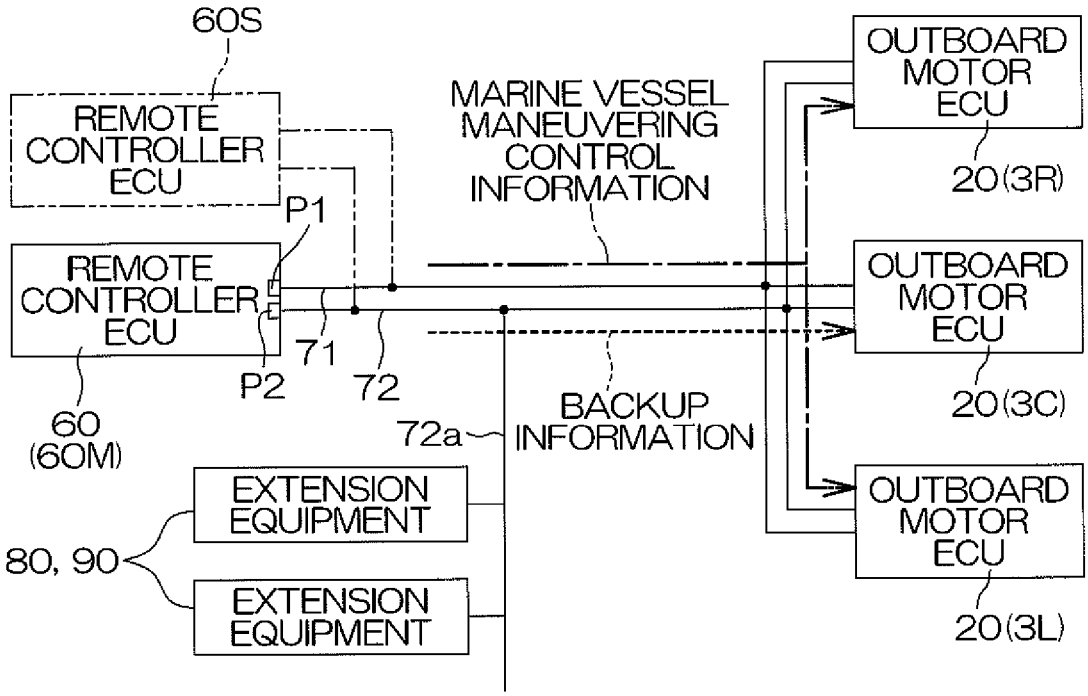
FIG. 7 is a schematic block diagram for explaining a fourth control example applicable to the first preferred embodiment of the present invention.

FIG. 7 is a schematic block diagram for explaining a fourth control example applicable to the present preferred embodiment. The remote controller ECU 60 sends out the marine vessel maneuvering control information to the first port P1 and sends out the backup information to the second port P2. The sending cycles of the marine vessel maneuvering control information and the backup information may differ but are preferably equal.

In the present control example, the marine vessel maneuvering control information includes the control commands (starboard-side commands) for the starboard-side outboard motor 3R and the control commands (port-side commands) for the port-side outboard motor 3L but does not include the control commands (central commands) for the central outboard motor 3C. The backup information includes the control commands (central commands) for the central outboard motor 3C but does not include either the starboard-side commands or the port-side commands. The information volume per unit time of the backup information is thus less than the information volume per unit time of the marine vessel maneuvering control information.

The outboard motor ECUs 20 of the starboard-side outboard motor 3R and the port-side outboard motor 3L respectively monitor the occurrence/non-occurrence of a fault of the first communication bus 71. In the normal state in which a fault is not occurring in the first communication bus 71, the outboard motor ECUs 20 of the starboard-side outboard motor 3R and the port-side outboard motor 3L control the actuators based respectively on the starboard-side commands and the port-side commands included in the marine vessel maneuvering control information. Also, at the central outboard motor 3C, the actuators are controlled according to the central commands included in the backup information sent via the second communication bus 72.

On the other hand, if it is determined that a fault is occurring in the first communication bus 71, the outboard motor ECUs 20 of the starboard-side outboard motor 3R and the port-side outboard motor 3L stop the control of the actuators. In this case, the engines of the starboard-side outboard motor 3R and the port-side outboard motor 3L may be put in a stopped state or in an idling rotation state. The shift position is controlled to be the neutral position and the steering angle is controlled to be zero. Even in this case, traveling of the marine vessel 1 is enabled because the central outboard motor 3C is controlled in accordance with the central commands included in the backup information.

All of the outboard motors 3 can thus be controlled by the first communication bus 71 and the second communication bus 72 complementing each other in the ordinary state. When a fault occurs in the first communication bus 71, the central outboard motor 3C can be operated by the central commands in the backup information transmitted via the second communication bus 72.

When a fault occurs in the second communication bus 72, the starboard-side and the port-side outboard motors 3R and 3L can be operated by the starboard-side commands and the port-side commands transmitted via the first communication bus 71, and the marine vessel 1 can thus be made to travel in this state as well. In this case, the engine of the central outboard motor 3C may be set to the stopped state or the idling rotation state. The shift position is controlled to be the neutral position and the steering angle is controlled to be zero.

2. Second Preferred Embodiment

Figure 8:
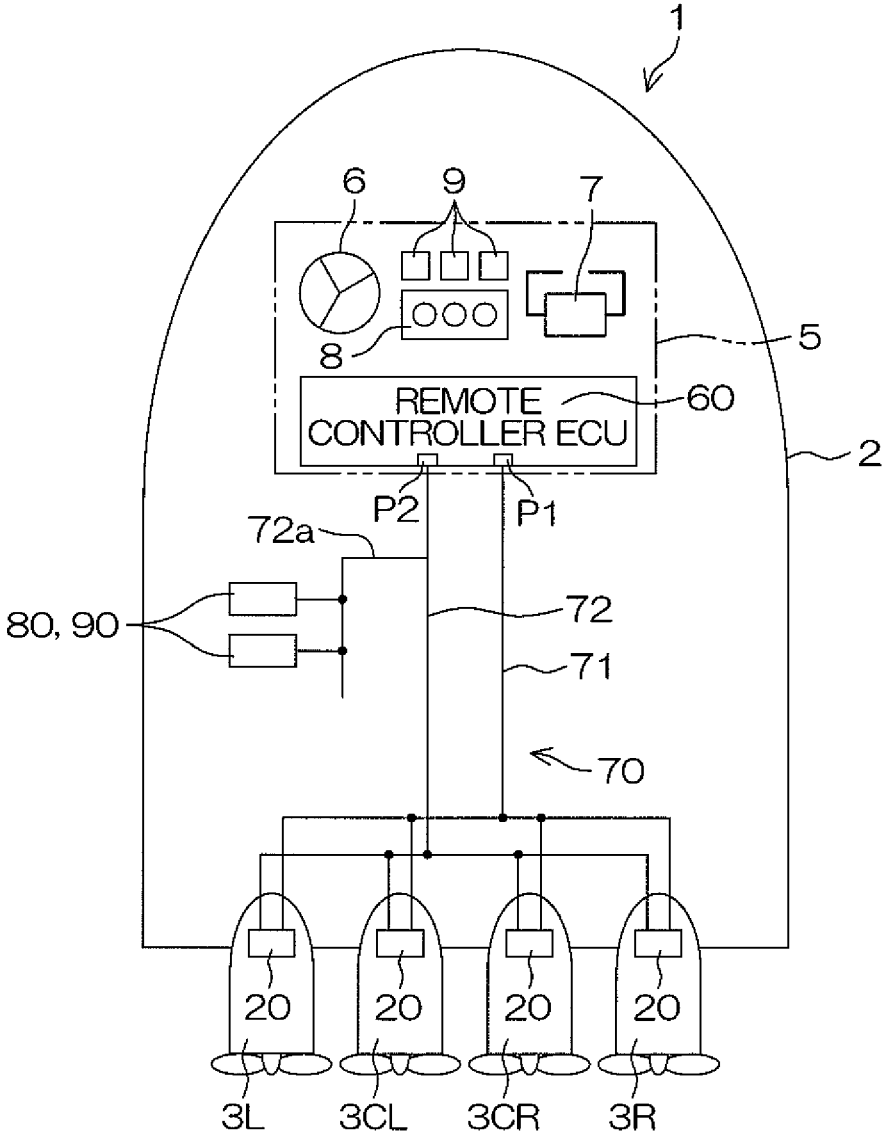
FIG. 8 is a schematic plan view for explaining an arrangement of a marine vessel according to a second preferred embodiment of the present invention.

FIG. 8 is a schematic plan view for explaining an arrangement of a marine vessel according to a second preferred embodiment of the present invention. In this preferred embodiment, four outboard motors 3 are preferably aligned in a single row along the right/left direction of the hull 2 at the stern of the hull 2. To distinguish the four outboard motors 3, the outboard motor 3 disposed at a starboard-most side shall be referred to as the "starboard-most-side outboard motor 3R," and the outboard motor 3 disposed at a port-most side shall be referred to as the "port-most-side outboard motor 3L." Further, of the two outboard motors 3 at the center, the outboard motor 3 at the starboard side shall be referred to as the "central starboard-side outboard motor 3CR," and the outboard motor 3 at the port side shall be referred to as the "central port-side outboard motor 3CL."

Each of the outboard motors 3 includes an outboard motor ECU 20. A single remote controller ECU 60 is included in the marine vessel maneuvering compartment 5. The remote controller ECU 60 and the four outboard motor ECUs 20 are connected by the first communication bus 71 and the second communication bus 72. The remote controller ECU 60 sends out the marine vessel maneuvering control information to the first communication bus 71 and sends out the backup information to the second communication bus 72. These can be received in each of the four outboard motor ECUs 20. As in the above described first preferred embodiment, the auxiliary devices 80 and 90 are connectable to the second communication bus 72.

2-1. First Control Example

A first control example applicable to the present preferred embodiment is substantially the same as the first control example in the first preferred embodiment (see FIG. 4). That is, the remote controller ECU 60 sends the marine vessel maneuvering control information to the first port P1 at the predetermined first cycle, and sends the backup information to the second port P2 at the predetermined second cycle. The second cycle is set longer than the first cycle.

The outboard motor ECUs 20 of the respective outboard motors 3 monitor the occurrence/non-occurrence of a fault of the first communication bus 71. In the normal state in which a fault is not occurring in the first communication bus 71, the respective outboard motor ECUs 20 control the actuators based on the marine vessel maneuvering control information sent via the first communication bus 71. On the other hand, if it is determined that a fault is occurring in the first communication bus 71, the outboard motor ECUs 20 control the actuators in accordance with the backup information sent via the second communication bus 72.

In the first control example, the outboard motor ECUs 20 of the respective outboard motors 3 may be arranged not to monitor the occurrence/non-occurrence of a fault of the first communication bus 71. The normal state in which a fault is not occurring in the first communication bus 71 is a state where the respective outboard motors ECUs 20 can receive information from either of the communication buses of the first communication bus and the second communication bus. In this state, the respective outboard motor ECUs 20 control the actuators (controlled objects) based on the marine vessel maneuvering control information, which is sent via the first communication bus 71 and is practically short in transmission cycle. On the other hand, a state in which a fault is occurring in the first communication bus 71 is a state in which the respective outboard motor ECUs 20 can acquire information from only the second communication bus. In this state, the outboard motor ECUs 20 control the actuators according to the backup information sent via the second communication bus 72. Thus, even if fault detection is not performed, the outboard motors ECU 20 can receive the control commands from the remote controller ECU 60 via the second communication bus 72 when a fault occurs in the first communication bus 71.

2-2. Second Control Example

A second control example applicable to the present preferred embodiment is substantially the same as the second control example in the above described first preferred embodiment (see FIG. 5). That is, the remote controller ECU 60 sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information.

The marine vessel maneuvering control information includes the control commands for all of the outboard motors 3. In contrast, the backup information includes only the control commands for a portion of the outboard motors 3. The information volume per unit time of the backup information is thus less than the information volume per unit time of the marine vessel maneuvering control information.

More specifically, the backup information may include only the control commands for the central starboard-side outboard motor 3CR and the central port-side outboard motor 3CL. Thus, when a fault occurs in the first communication bus 71, operations of the port-most-side outboard motor 3L and the starboard-most-side outboard motor 3R are stopped and only the two outboard motors 3CR and 3CL at the center are operable. The marine vessel 1 can thus be made to travel, albeit in a mode that is more restricted than the ordinary state. Preferably, the steering angle is controlled to be zero at the port-most-side outboard motor 3L and the starboard-most-side outboard motor 3R.

The backup information may instead include only the control commands of the port-most-side outboard motor 3L and the starboard-most-side outboard motor 3R and not include the control commands for the two outboard motors 3CR and 3CL at the center. In this case, when a fault occurs in the first communication bus 71, the operations of the two outboard motors 3CR and 3CL at the center are stopped and only the port-most-side outboard motor 3L and the starboard-most-side outboard motor 3R are operable. The marine vessel 1 can thus be made to travel, albeit in a mode that is more restricted than the ordinary state. Preferably, the steering angle is controlled to be zero at the two outboard motors 3CR and 3CL at the center.

In addition, when a fault occurs in the first communication bus 71, operation of the engine at the idling rotational speed may be performed instead of stopping of operation at the outboard motor for which the control commands are not included in the backup information. In this case, the shift position is preferably controlled to be the neutral position.

2-3. Third Control Example

Figure 9:
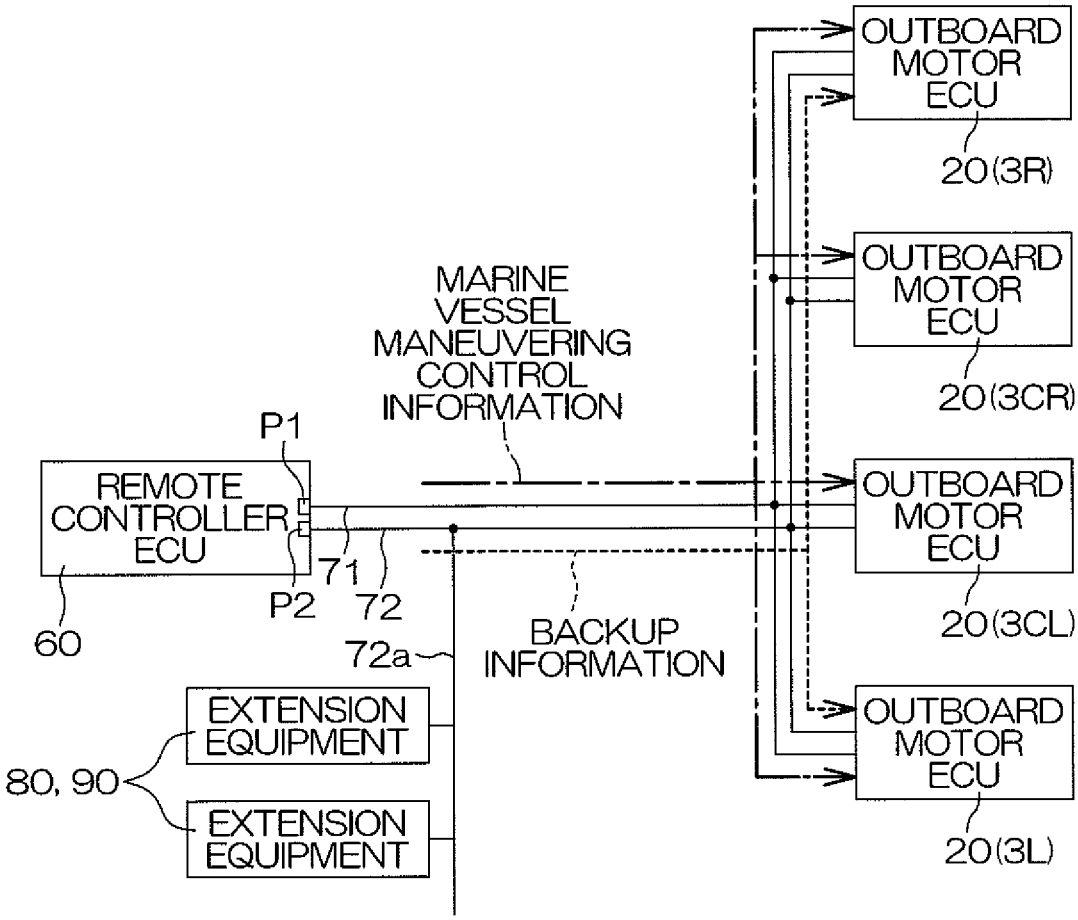
FIG. 9 is a schematic block diagram for explaining a control example applicable to the second preferred embodiment of the present invention.
Figure 10:
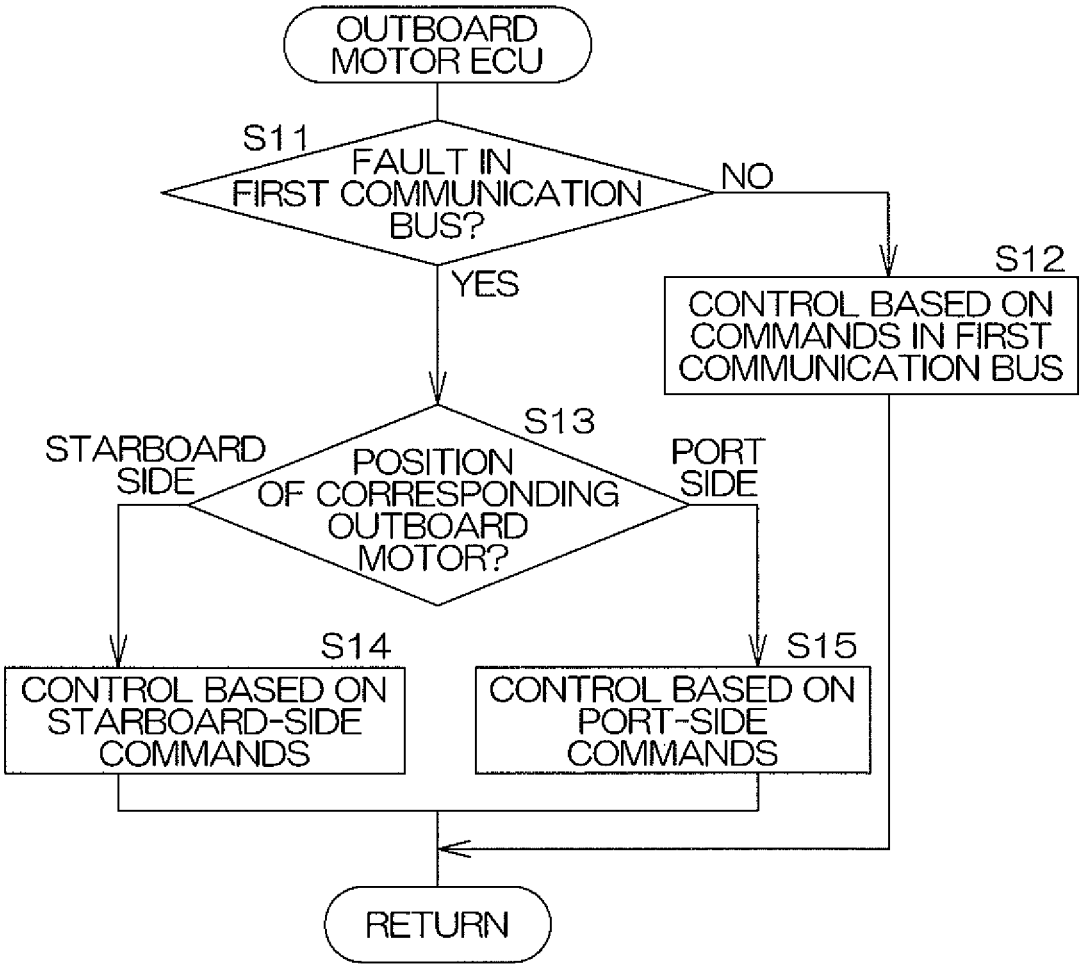
FIG. 10 is a flowchart of a process executed in each outboard motor in the control example of FIG. 9.

FIG. 9 is a schematic block diagram for explaining a third control example applicable to the present preferred embodiment. FIG. 10 is a flowchart of a process executed in the outboard motor ECU 20 of each outboard motor 3. In the present control example, the remote controller ECU 60 sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information. In the present control example, the marine vessel maneuvering control information includes the control commands for all of the outboard motors 3. On the other hand, the backup information includes the control commands (starboard-side commands) for the starboard-most-side outboard motor 3R and the control commands (port-side commands) for the port-most-side outboard motor 3L but does not include the control commands for the two outboard motors 3CR and 3CL at the center.

The outboard motor ECUs 20 of the respective outboard motors 3 monitor the occurrence/non-occurrence of a fault of the first communication bus 71 (step S11). In the normal state in which a fault is not occurring in the first communication bus 71 (step S11: NO), the respective outboard motor ECUs 20 control the actuators based on the marine vessel maneuvering control information sent via the first communication bus 71 (step S12). On the other hand, if it is determined that a fault is occurring in the first communication bus 71 (step S11: YES), each outboard motor ECU 20 determines the position of the corresponding outboard motor 3 (step S13). That is, the outboard motor ECU 20 holds, outboard motor identification data indicating which of the starboard-most-side outboard motor 3R, the port-most-side outboard motor 3L, the central starboard-side motor 3CR, and the central port-side motor 3CL is corresponding to the outboard motor ECU 20. The outboard motor ECU 20 determines the position of the corresponding outboard motor based on the outboard motor identification data. Specifically, it is determined whether the corresponding outboard motor is the outboard motor 3CR or 3R at the starboard side relative to the center or is the outboard motor 3CL or 3L at the port side relative to the center. If the corresponding outboard motor is the outboard motor 3CR or 3R at the starboard side, the outboard motor ECU 20 controls the actuators of the corresponding outboard motor 3CR or 3R based on the starboard-side outboard motor control commands (starboard-side commands) included in the backup information sent via the second communication bus 72 (step S14). If the corresponding outboard motor is the outboard motor 3CL or 3L at the port side, the outboard motor ECU 20 controls the actuators of the corresponding port-side outboard motor 3CL or 3L based on the port-side outboard motor control commands (port-side commands) included in the backup information sent via the second communication bus 72 (step S15).

All of the outboard motors 3 can thus be controlled based on the starboard-side commands and the port-side commands included in the backup information. The marine vessel 1 can thereby be made to travel by operating all of the outboard motors 3 even when a fault occurs in the first communication bus 71.

2-4. Fourth Control Example

Figure 11:
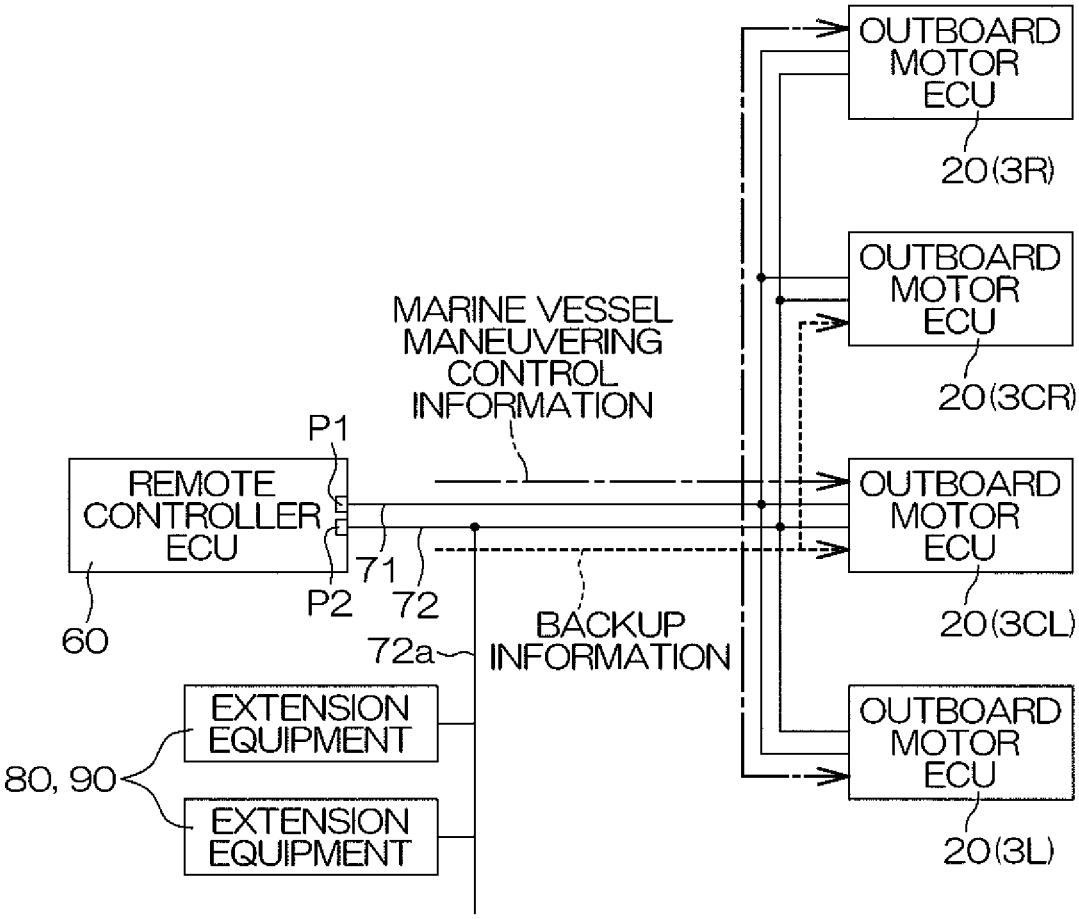
FIG. 11 is a schematic block diagram for explaining another control example applicable to the second preferred embodiment of the present invention.

FIG. 11 is a schematic block diagram for explaining a fourth control example applicable to the present preferred embodiment. The remote controller ECU 60 sends out the marine vessel maneuvering control information to the first port P1 and sends out the backup information to the second port P2. The sending cycles of the marine vessel maneuvering control information and the backup information may differ but are preferably equal.

In the present control example, the marine vessel maneuvering control information includes control commands (starboard-most-side commands) for the starboard-most-side outboard motor 3R and control commands (port-most-side commands) for the port-most-side outboard motor 3L but does not include control commands (central port-side commands and central starboard-side commands) for the two outboard motors 3CL and 3CR at the center. The backup information includes the control commands (central port-side commands) for the central port-side outboard motor 3CL and the control commands (central starboard-side commands) for the central starboard-side outboard motor 3CR but does not include either the starboard-most-side commands or the port-most-side commands.

The outboard motor ECUs 20 of the starboard-most-side outboard motor 3R and the port-most-side outboard motor 3L respectively monitor the occurrence/non-occurrence of a fault of the first communication bus 71. In the normal state in which a fault is not occurring in the first communication bus 71, the outboard motor ECUs 20 of the starboard-most-side outboard motor 3R and the port-most-side outboard motor 3L control the actuators based respectively on the starboard-most-side commands and the port-most-side commands. The outboard motor ECU 20 of the central starboard-side outboard motor 3CR controls the actuators according to the central starboard-side commands included in the backup information sent via the second communication bus 72. Likewise, the outboard motor ECU 20 of the central port-side outboard motor 3CL controls the actuators according to the central port-side commands included in the backup information sent via the second communication bus 72.

On the other hand, if it is determined that a fault is occurring in the first communication bus 71, the outboard motor ECUs 20 of the starboard-most-side outboard motor 3R and the port-most-side outboard motor 3L stop the control of the actuators. In this case, the engines of the starboard-most-side outboard motor 3R and the port-most-side outboard motor 3L may be put in a stopped state or in an idling rotation state. The shift position is controlled to be the neutral position and the steering angle is controlled to be zero. Even in this case, traveling of the marine vessel 1 is enabled because the central starboard-side outboard motor 3CR and the central port-side outboard motor 3CL are respectively controlled in accordance with the central starboard-side commands and the central port-side commands included in the backup information.

All of the outboard motors 3 can thus be controlled by the first communication bus 71 and the second communication bus 72 complementing each other in the ordinary state. When a fault occurs in the first communication bus 71, the two outboard motors 3CR and 3CL at the center can be operated by the central starboard-side commands and central port-side commands in the backup information transmitted via the second communication bus 72. In this case, the second communication bus 72 is used for the transmission of not only the backup information but also the auxiliary information for the auxiliary devices 80 and 90, and the control response may be delayed somewhat. The operation state is thus restricted in comparison to the normal state. Even then, it is possible to make the marine vessel 1 travel.

When a fault occurs in the second communication bus 72, the starboard-side and the port-side outboard motors 3R and 3L can be operated by the starboard-most-side commands and the port-most-side commands transmitted via the first communication bus 71 and the marine vessel 1 can thus be made to travel in this state as well. In this case, the engines of the two outboard motors 3CR and 3CL at the center may be set to the stopped state or the idling rotation state. The shift position is controlled to be the neutral position and the steering angle is controlled to be zero.

When a fault occurs in the first communication bus 71, instead of stopping the operations of the starboard-most-side outboard motor 3R and the port-most-side outboard motor 3L (or putting these motors in the idling state), these motors may be operated using the control commands included in the backup information. Specifically, when a fault occurs in the first communication bus 71, the outboard motor ECU 20 of the starboard-most-side outboard motor 3R may perform control of the actuators according to the central starboard-side commands. Likewise, when a fault occurs in the first communication bus 71, the outboard motor ECU 20 of the port-most-side outboard motor 3L may perform control of the actuators according to the central port-side commands.

Likewise, when a fault occurs in the second communication bus 72, instead of stopping the operations of the central starboard-side outboard motor 3CR and the central port-side outboard motor 3CL (or putting these motors in the idling state), these motors may be operated using the control commands included in the marine vessel maneuvering control information. Specifically, when a fault occurs in the second communication bus 72, the outboard motor ECU 20 of the central starboard-side outboard motor 3CR may perform control of the actuators according to the starboard-most-side commands. Likewise, when a fault occurs in the second communication bus 72, the outboard motor ECU 20 of the central port-side outboard motor 3CL may perform control of the actuators according to the port-most side commands.

The marine vessel maneuvering control information transmitted through the first communication bus 71 may be allocated to the two outboard motors 3CR and 3CL at the center, and the backup information transmitted through the second communication bus 72 may be allocated to the port-most-side and starboard-most-side outboard motors 3L and 3R.

3. Third Preferred Embodiment

Figure 12:
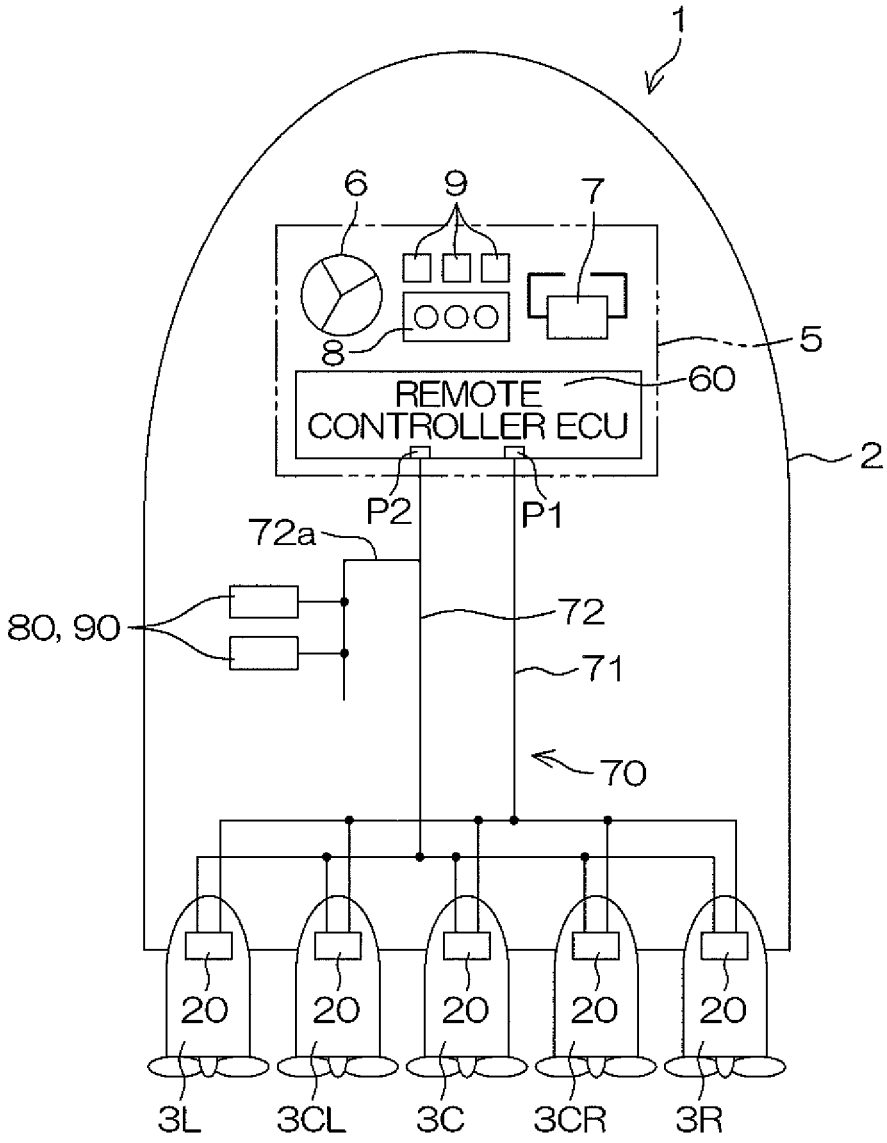
FIG. 12 is a schematic plan view for explaining an arrangement of a marine vessel according to a third preferred embodiment of the present invention.

FIG. 12 is a schematic plan view for explaining an arrangement of a marine vessel according to a third preferred embodiment of the present invention. In this preferred embodiment, five outboard motors 3 preferably are aligned in a single row along the right/left direction of the hull 2 at the stern of the hull 2. To distinguish the five outboard motors 3, the outboard motor 3 disposed at a starboard-most side shall be referred to as the "starboard-most-side outboard motor 3R," the outboard motor 3 disposed at a port-most side shall be referred to as the "port-most-side outboard motor 3L," and the outboard motor 3 at the center shall be referred to as the "central outboard motor 3C." Further, the outboard motor 3 between the central outboard motor 3C and the starboard-most-side outboard motor 3R shall be referred to as the "central starboard-side outboard motor 3CR," and the outboard motor 3 between the central outboard motor 3C and the port-most-side outboard motor 3L shall be referred to as the "central port-side outboard motor 3CL."

Each of the outboard motors 3 includes an outboard motor ECU 20. A single remote controller ECU 60 is included in the marine vessel maneuvering compartment 5. The remote controller ECU 60 and the five outboard motor ECUs 20 are connected by the first communication bus 71 and the second communication bus 72. The remote controller ECU 60 sends out the marine vessel maneuvering control information to the first communication bus 71 and sends out the backup information to the second communication bus 72. This information can be received in each of the five outboard motor ECUs 20. As in the above described first preferred embodiment, the auxiliary devices 80 and 90 are connectable to the second communication bus 72.

3-1. First Control Example

A first control example applicable to the present preferred embodiment is substantially the same as the first control example in the first preferred embodiment (see FIG. 4). That is, the remote controller ECU 60 sends out the marine vessel maneuvering control information to the first port P1 at the predetermined first cycle, and sends out the backup information to the second port P2 at the predetermined second cycle. The second cycle is set longer than the first cycle.

The outboard motor ECUs 20 of the respective outboard motors 3 monitor the occurrence/non-occurrence of a fault of the first communication bus 71. In the normal state in which a fault is not occurring in the first communication bus 71, the respective outboard motor ECUs 20 control the actuators based on the marine vessel maneuvering control information sent via the first communication bus 71. On the other hand, if it is determined that a fault is occurring in the first communication bus 71, the outboard motor ECUs 20 control the actuators in accordance with the backup information sent via the second communication bus 72.

In the first control example, the outboard motor ECUs 20 of the respective outboard motors 3 may be arranged not to monitor the occurrence/non-occurrence of a fault of the first communication bus 71. The normal state in which a fault is not occurring in the first communication bus 71 is a state where the respective outboard motors ECUs 20 can receive information from either of the communication buses of the first communication bus and the second communication bus. In this state, the respective outboard motor ECUs 20 control the actuators (controlled objects) based on the marine vessel maneuvering control information, which is sent via the first communication bus 71 and is practically short in transmission cycle. On the other hand, a state in which a fault is occurring in the first communication bus 71 is a state in which the respective outboard motor ECUs 20 can acquire information from only the second communication bus. In this state, the outboard motor ECUs 20 control the actuators according to the backup information sent via the second communication bus 72. Thus, even if fault detection is not performed, the outboard motors ECU 20 can receive the control commands from the remote controller ECU 60 via the second communication bus 72 when a fault occurs in the first communication bus 71.

3-2. Second Control Example

A second control example applicable to the present preferred embodiment is substantially the same as the second control example in the above described first preferred embodiment (see FIG. 5). That is, the remote controller ECU 60 sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information.

The marine vessel maneuvering control information includes the control commands for all of the outboard motors 3. In contrast, the backup information includes only the control commands for a portion of the outboard motors 3. The information volume per unit time of the backup information is thus less than the information volume per unit time of the marine vessel maneuvering control information.

More specifically, the backup information may include only the control commands for the central outboard motor 3C, the starboard-most-side outboard motor 3R, and the port-most-side outboard motor 3L. Thus, when a fault occurs in the first communication bus 71, operations of the central starboard-side outboard motor 3CR and the central port-side outboard motor 3CL are stopped and only the central outboard motor 3C, the starboard-most-side outboard motor 3R, and the port-most-side outboard motor 3L are operable. The marine vessel 1 can thus be made to travel, albeit in a mode that is more restricted than the ordinary state. Preferably, the steering angle is controlled to be zero at the central starboard-side outboard motor 3CR and the central port-side outboard motor 3CL.

The backup information may instead include only the control commands for the central starboard-side outboard motor 3CR and the central port-side outboard motor 3CL and not include the control commands for the central outboard motor 3C, the starboard-most-side outboard motor 3R, and the port-most-side outboard motor 3L. In this case, when a fault occurs in the first communication bus 71, the operations of the central outboard motor 3C, the starboard-most-side outboard motor 3R, and the port-most-side outboard motor 3L are stopped and only the central starboard-side outboard motor 3CR and the central port-side outboard motor 3CL are operable. The marine vessel 1 can thus be made to travel, albeit in a mode that is more restricted than the ordinary state. Preferably, the steering angle is controlled to be zero at the starboard-most-side outboard motor 3R, the port-most-side outboard motor 3L, and the central outboard motor 3C.

In addition, when a fault occurs in the first communication bus 71, operation of the engine at the idling rotational speed may be performed instead of stopping of operation at the outboard motor for which the control commands are not included in the backup information. In this case, the shift position is preferably controlled to be the neutral position.

3-3. Third Control Example

Figure 13:
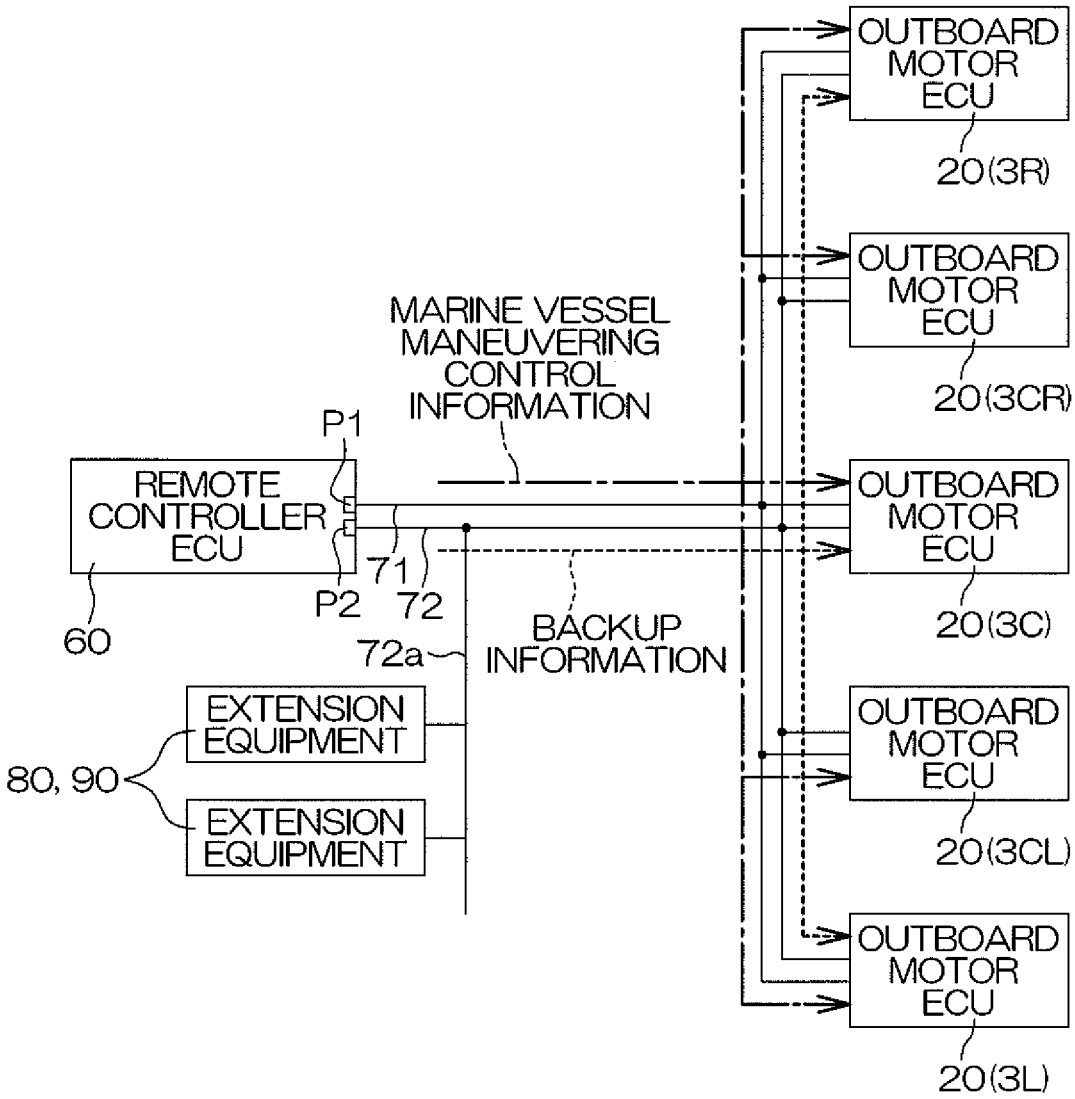
FIG. 13 is a schematic block diagram for explaining a control example applicable to the third preferred embodiment of the present invention.
Figure 14:
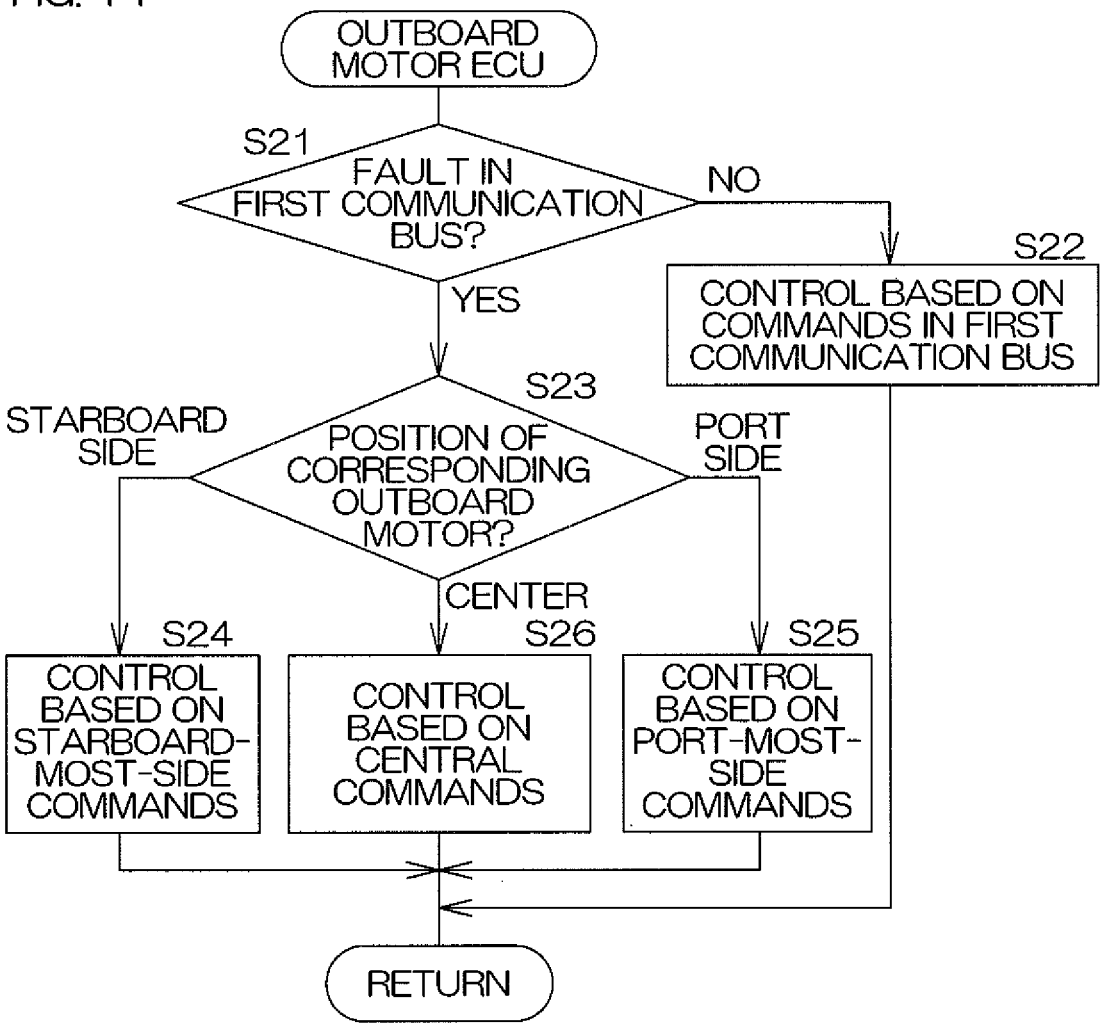
FIG. 14 is a flowchart of a process executed in each outboard motor in the control example of FIG. 13.

FIG. 13 is a schematic block diagram for explaining a third control example applicable to the present preferred embodiment. In addition, FIG. 14 is a flowchart of a process executed in the outboard motor ECU 20 of each outboard motor 3. In the present control example, the remote controller ECU 60 sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information. In the present control example, the marine vessel maneuvering control information includes the control commands for all of the outboard motors 3. The backup information includes the control commands (central commands) for the central outboard motor 3C, the control commands (starboard-most-side commands) for the starboard-most-side outboard motor 3R, and the control commands (port-most-side commands) for the port-most-side outboard motor 3L. The backup information does not include the control commands (central starboard-side commands) for the central starboard-side outboard motor 3CR and the control commands (central port-side commands) for the central port-side outboard motor 3CL.

The outboard motor ECUs 20 of the respective outboard motors 3 monitor the occurrence/non-occurrence of a fault of the first communication bus 71 (step S21). In the normal state in which a fault is not occurring in the first communication bus 71 (step S21: NO), the respective outboard motor ECUs 20 control the actuators based on the marine vessel maneuvering control information sent via the first communication bus 71 (step S22). On the other hand, if it is determined that a fault is occurring in the first communication bus 71 (step S21: YES), each outboard motor ECU 20 determines the position of the corresponding outboard motor 3 (step S23). That is, the outboard motor ECU 20 holds, outboard motor identification data indicating which of the starboard-most-side outboard motor 3R, the port-most-side outboard motor 3L, the central outboard motor 3C, the central starboard-side motor 3CR, and the central port-side motor 3CL is corresponding to the outboard motor ECU 20. The outboard motor ECU 20 determines the position of the corresponding outboard motor based on the outboard motor identification data. Specifically, it is determined whether the corresponding outboard motor is the central outboard motor 3C, the outboard motor 3CR or 3R at the starboard side relative to the center, or the outboard motor 3CL or 3L at the port side relative to the center. If the corresponding outboard motor is the outboard motor 3CR or 3R at the starboard side, the outboard motor ECU 20 controls the actuators of the corresponding outboard motor 3CR or 3R based on the starboard-most-side outboard motor control commands (starboard-most-side commands) included in the backup information sent via the second communication bus 72 (step S24). Also, if the corresponding outboard motor is the outboard motor 3CL or 3L at the port side, the outboard motor ECU 20 controls the actuators of the corresponding port-side outboard motor 3CL or 3L based on the port-most-side outboard motor control commands (port-most-side commands) included in the backup information sent via the second communication bus 72 (step S25). Further, if the corresponding outboard motor is the central outboard motor 3C, the outboard motor ECU 20 controls the actuators of the corresponding central outboard motor 3C based on the central outboard motor control commands (central commands) included in the backup information sent via the second communication bus 72 (step S26).

All of the outboard motors 3 can thus be controlled based on the starboard-most-side commands, the port-most-side commands, and the central commands included in the backup information. The marine vessel 1 can thereby be made to travel by operating all of the outboard motors 3 even when a fault occurs in the first communication bus 71.

3-4. Fourth Control Example

Figure 15:
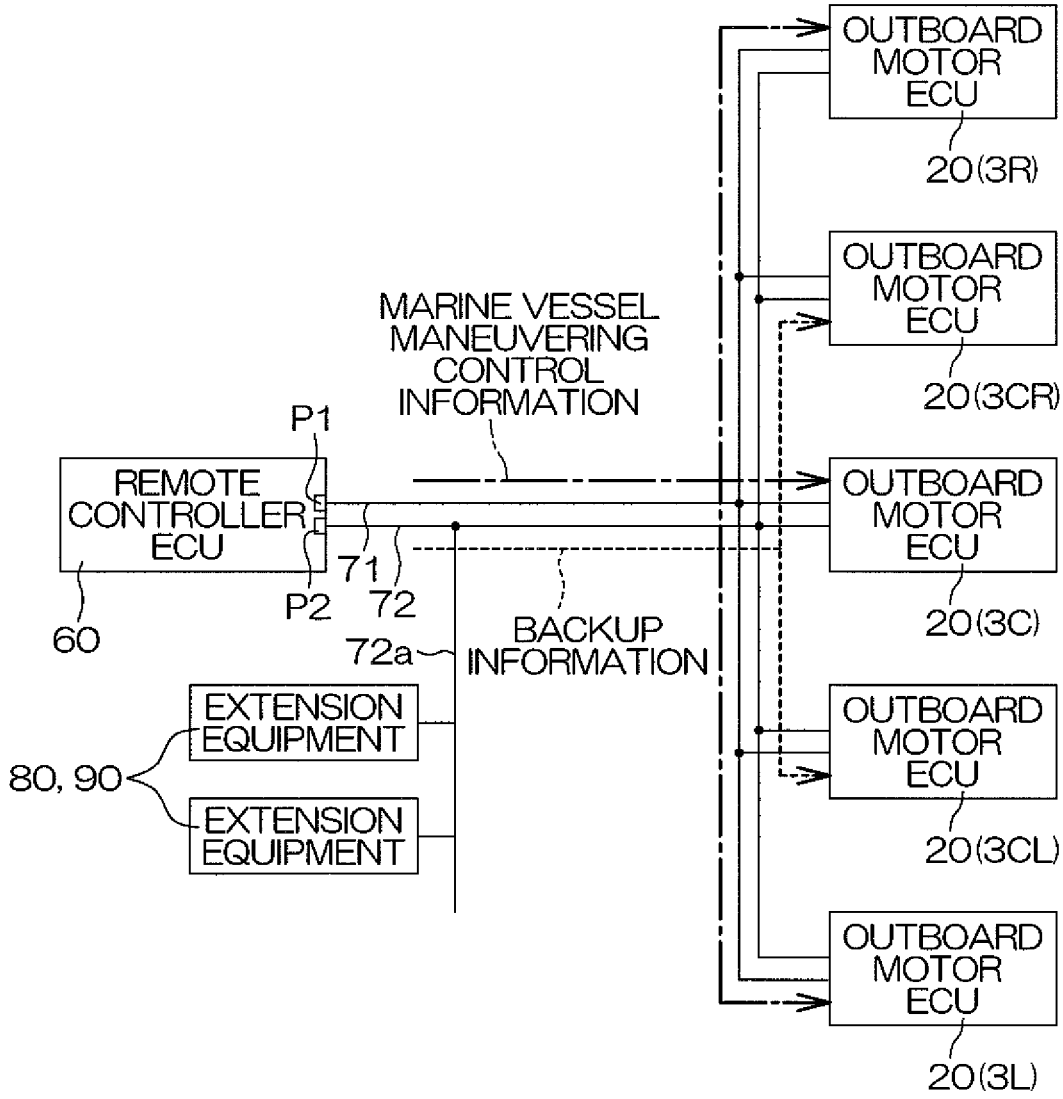
FIG. 15 is a schematic block diagram for explaining another control example applicable to the third preferred embodiment of the present invention.

FIG. 15 is a schematic block diagram for explaining a fourth control example applicable to the present preferred embodiment. The remote controller ECU 60 sends out the marine vessel maneuvering control information to the first port P1 and sends out the backup information to the second port P2. The sending cycles of the marine vessel maneuvering control information and the backup information may differ but are preferably equal.

In the present control example, the marine vessel maneuvering control information includes the control commands (starboard-most-side commands) for the starboard-most-side outboard motor 3R, the control commands (port-most-side commands) for the port-most-side outboard motor 3L, and the control commands (central commands) for the central outboard motor 3C. The marine vessel maneuvering control information does not include the control commands (central port-side commands and central starboard-side commands) for the central starboard-side outboard motor 3CR and the central port-side outboard motor 3CL. Meanwhile, the backup information includes the control commands (central port-side commands) for the central port-side outboard motor 3CL and the control commands (central starboard-side commands) for the central starboard-side outboard motor 3CR but does not include any of the port-most-side commands, the starboard-most-side commands, and the central commands.

The outboard motor ECUs 20 of the starboard-most-side outboard motor 3R, the port-most-side outboard motor 3L, and the central outboard motor 3C respectively monitor the occurrence/non-occurrence of a fault of the first communication bus 71. In the normal state in which a fault is not occurring in the first communication bus 71, the outboard motor ECUs 20 of the starboard-most-side outboard motor 3R, the port-most-side outboard motor 3L, and the central outboard motor 3C control the actuators based respectively on the starboard-most-side commands, the port-most-side commands, and the central commands included in the marine vessel maneuvering control information. Also, the outboard motor ECU 20 of the central starboard-side outboard motor 3CR controls the actuators according to the central starboard-side commands included in the backup information sent via the second communication bus 72. Likewise, the outboard motor ECU 20 of the central port-side outboard motor 3CL controls the actuators according to the central port-side commands included in the backup information sent via the second communication bus 72.

On the other hand, if it is determined that a fault is occurring in the first communication bus 71, the outboard motor ECUs 20 of the starboard-most-side outboard motor 3R, the port-most-side outboard motor 3L, and the central outboard motor 3C stop the control of the actuators. In this case, the engines of the starboard-most-side outboard motor 3L, the port-side outboard motor 3R, and the central outboard motor 3C may be put in a stopped state or in an idling rotation state. The shift position is controlled to be the neutral position and the steering angle is controlled to be zero. Even in this case, traveling of the marine vessel 1 is enabled because the central starboard-side outboard motor 3CR and the central port-side outboard motor 3CL are respectively controlled in accordance with the central starboard-side commands and the central port-side commands included in the backup information.

All of the outboard motors 3 can thus be controlled by the first communication bus 71 and the second communication bus 72 complementing each other in the ordinary state. When a fault occurs in the first communication bus 71, the two outboard motors 3CR and 3CL can be operated by the central starboard-side commands and central port-side commands in the backup information transmitted via the second communication bus 72. In this case, the second communication bus 72 is used for transmission of not only the backup information but also the auxiliary information for the auxiliary devices 80 and 90, and the control response may be delayed somewhat. The operation state is thus restricted in comparison to the normal state. Even then, it is possible to make the marine vessel 1 travel. Also, the second communication bus 72 suffices to be used for the transmission of the control commands of two of the outboard motors 3, and the communication load related to the control commands is thus lower than that of the first communication bus 71.

When a fault occurs in the second communication bus 72, the starboard-most-side and the port-most-side outboard motors 3R and 3L and the central outboard motor 3C can be operated by the starboard-most-side commands, the port-most-side commands, and the central commands transmitted via the first communication bus 71, and the marine vessel 1 can thus be made to travel in this state as well. In this case, the engines of the other two outboard motors 3CL and 3CR may be set to the stopped state or the idling rotation state. The shift position is controlled to be the neutral position and the steering angle is controlled to be zero.

When a fault occurs in the first communication bus 71, instead of stopping the operations of the starboard-most-side outboard motor 3R and the port-most-side outboard motor 3L (or putting these motors in the idling state), these motors may be operated using the control commands included in the backup information. Specifically, when a fault occurs in the first communication bus 71, the outboard motor ECU 20 of the starboard-most-side outboard motor 3R may perform control of the actuators according to the central starboard-side commands. Likewise, when a fault occurs in the first communication bus 71, the outboard motor ECU 20 of the port-most-side outboard motor 3L may perform control of the actuators according to the central port-side commands. Also, when a fault occurs in the first communication bus 71, instead of stopping the operation of the central outboard motor 3C (or putting this motor in the idling state), the control of the actuators may be performed according to the central starboard-side commands and the central port-side commands included in the backup information. In this case, the control of the central outboard motor 3C is performed in accordance with the third control example of the first preferred embodiment.

Also, when a fault occurs in the second communication bus 72, instead of stopping the operations of the central starboard-side outboard motor 3CR and the central port-side outboard motor 3CL (or putting these motors in the idling state), these motors may be operated using the control commands included in the marine vessel maneuvering control information. Specifically, when a fault occurs in the second communication bus 72, the outboard motor ECU 20 of the central starboard-side outboard motor 3CR may perform control of the actuators according to the starboard-most-side commands. Likewise, when a fault occurs in the second communication bus 72, the outboard motor ECU 20 of the central port-side outboard motor 3CL may perform control of the actuators according to the port-most side commands.

The marine vessel maneuvering control information transmitted through the first communication bus 71 may be allocated to the central starboard-side outboard motor 3CR and the central port-side outboard motor 3CL, and the backup information transmitted through the second communication bus 72 may be allocated to the port-most-side, starboard-most-side, and central outboard motors 3L, 3R, and 3C.

4. Fourth Preferred Embodiment

Figure 16:
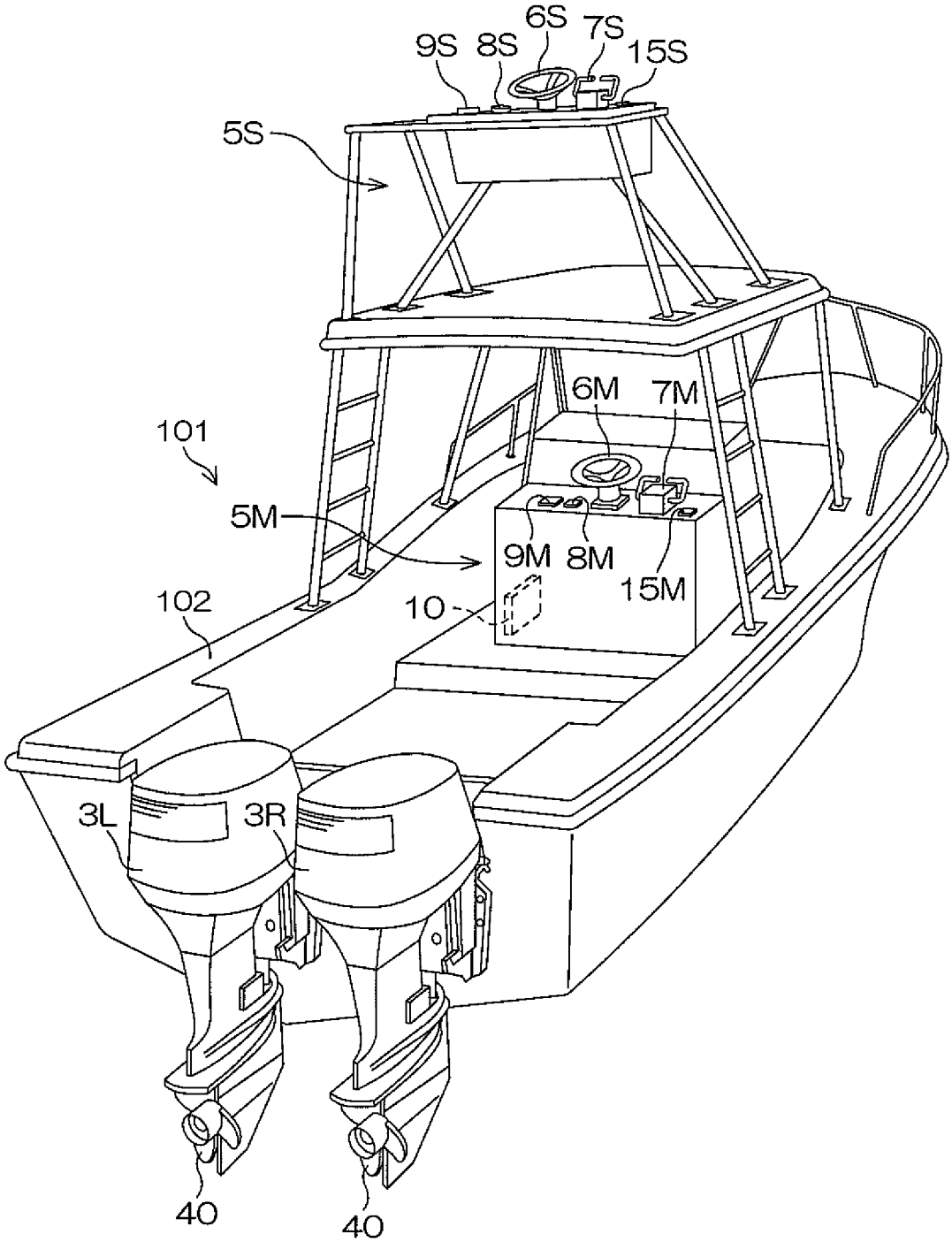
FIG. 16 is a perspective view for explaining an arrangement of a marine vessel according to a fourth preferred embodiment of the present invention.

FIG. 16 is a perspective view for explaining an arrangement of a marine vessel to which a marine vessel control system according to a fourth preferred embodiment of the present invention is applied. In FIG. 16, portions corresponding to the respective portions indicated in FIG. 1 described above shall be provided with the same reference symbols.

The present marine vessel 101 includes a hull 102 and two outboard motors 3. The two outboard motors 3 are attached to a tail (stern) of the hull 102, and the attachment structure is substantially the same as that in the first preferred embodiment. The two outboard motors 3 include the starboard-side outboard motor 3R, disposed at the right side facing the heading direction of the marine vessel 101, and the port-side outboard motor 3L disposed at the left side.

Two marine vessel maneuvering stations 5M and 5S (marine vessel maneuvering compartments) are installed on the hull 102. Specifically, the main station 5M (main marine vessel maneuvering compartment) is disposed at a center of the hull 102, and the sub station 5S (sub marine vessel maneuvering compartment) is disposed above the main station 5M. The marine vessel operator can perform operations for marine vessel maneuvering at either of the marine vessel maneuvering stations 5M and 5S.

A main steering apparatus 6M, a main remote controller 7M, a main operation panel 8M, a main gauge 9M, and a main station changeover switch 15M are disposed at the main station 5M. Likewise, a sub steering apparatus 6S, a sub remote controller 7S, a sub operation panel 8S, a sub gauge 9S, and a sub station changeover switch 15S are disposed at the sub station 5S. The immobilizer 10 (receiver) is disposed, for example, at the main station 5M.

The arrangement and function of each of the main steering apparatus 6M and the sub steering apparatus 6S are substantially the same as those of the steering apparatus 6 described for the first preferred embodiment. The arrangement and function of each of the main remote controller 7M and the sub remote controller 7S are substantially the same as those of the remote controller 7 described for the first preferred embodiment. The arrangement and function of each of the main operation panel 8M and the sub operation panel 8S are substantially the same as those of the operation panel 8 described in the first preferred embodiment and each includes the below-described two key switches 4R and 4L (see FIG. 17) corresponding to the starboard-side and port-side outboard motors 3R and 3L. Further, the function of each of the main gauge 9M and the sub gauge 9S is substantially the same as that of the gauge 9 described for the first preferred embodiment.

The main station changeover switch 15M and the sub station changeover switch 15S are arranged to be operated for switching the marine vessel maneuvering station between the main station 5M and the station 5S. More specifically, the main station changeover switch 15M is arranged to be operated by the user to prioritize the control commands from the main station 5M and make ineffective the control commands from the sub station 5S. Likewise, the sub station changeover switch 15S is arranged to be operated by the user to prioritize the control commands from the sub station 5S and make ineffective the control commands from the main station 5M.

Figure 17:
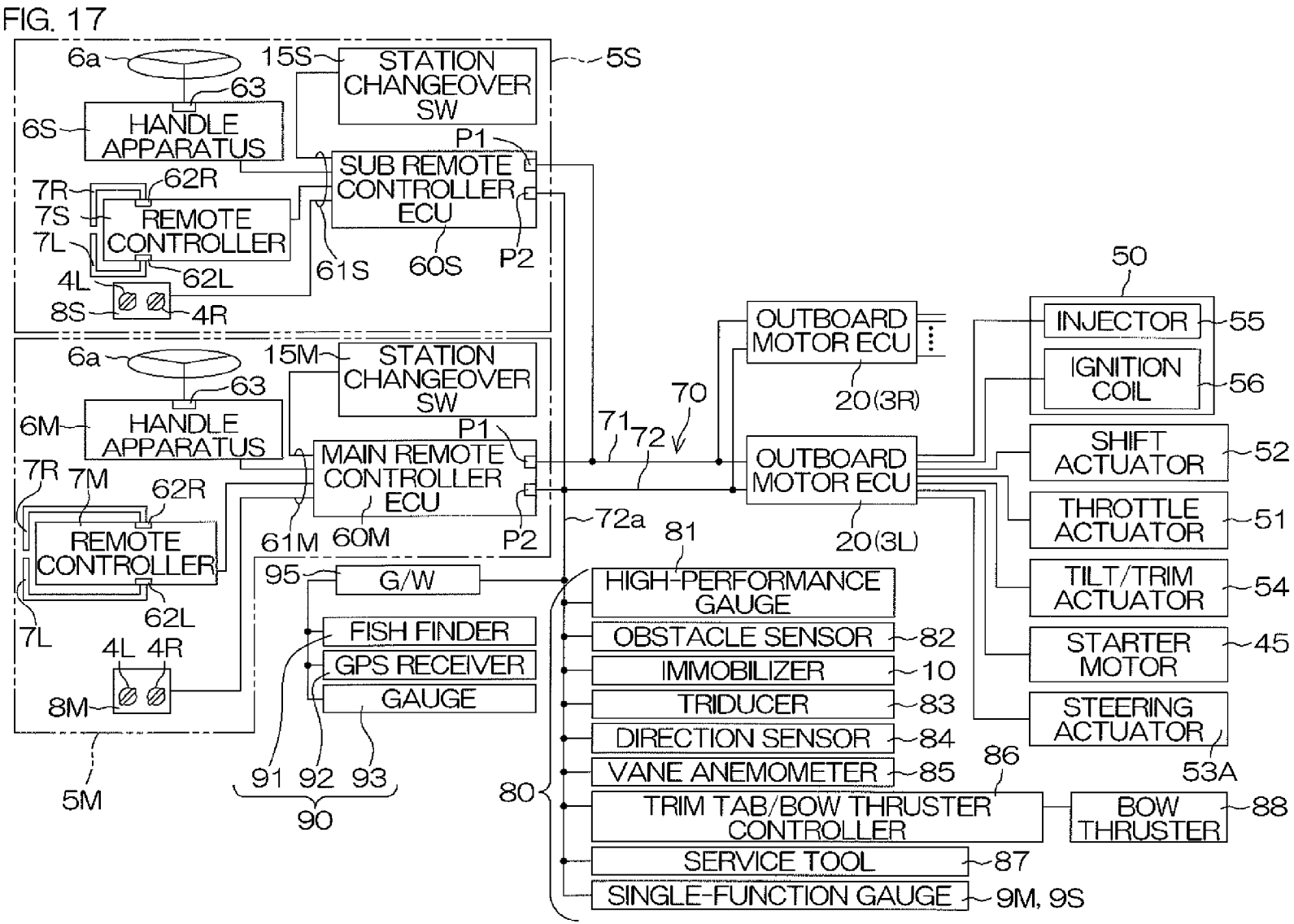
FIG. 17 is a block diagram for explaining an electrical arrangement of the marine vessel according to the fourth preferred embodiment of the present invention.

FIG. 17 is a block diagram for explaining an electrical arrangement of the marine vessel 101. In FIG. 17, portions corresponding to respective portions in FIG. 3 described above are provided with the same reference symbols. A main remote controller ECU 60M is provided in correspondence to the main station 5M and a sub remote controller ECU 60S is provided in correspondence to the sub station 5S. Each of these has substantially the same arrangement as the remote controller ECU 60 described for the above described first preferred embodiment. That is, the main remote controller 7M and the sub remote controller 7S are respectively connected via analog signal lines 61M and 61S to the main remote controller ECU 60M and the sub remote controller ECU 60S. Also, signals from the main operation panel 8M and the sub operation panel 8S are respectively input into the main remote controller ECU 60M and the sub remote controller ECU 60S. Further, the main steering apparatus 6M and the sub steering apparatus 6S are respectively connected to the main remote controller ECU 60M and the sub remote controller ECU 60S. Although not shown, a joystick, a power tilt/trim switch, and other operation apparatuses may furthermore be connected as necessary to the main remote controller ECU 60M. These operation apparatuses may also be connected to the sub remote controller ECU 60S. Each of the main remote controller ECU 60M and the sub remote controller ECU 60S has a microcomputer incorporated therein and generates control commands for controlling the outboard motors 3L and 3R according to the input signals.

Both the main remote controller ECU 60M and the sub remote controller ECU 60S communicate with the respective outboard motor ECUs 20 of the outboard motors 3L and 3R via the CAN 70. The first communication bus 71 of the CAN 70 is used for communication between the remote controller ECUs 60M and 60S with the outboard motor ECUs 20. In the present preferred embodiment, the first communication bus 71 is also used for communication between the main remote controller ECU 60M and the sub remote controller ECU 60S. The second communication bus 72 is used for communication between the remote controller ECUs 60S and 60M and the outboard motor ECUs 20 and for communication of information (auxiliary information) for the auxiliary devices 80 and 90 for extending the functions of the marine vessel 1. Thus, via the second communication bus 72, communication of the remote controller ECUs 60M and 60S with all of the outboard motor ECUs 20 and the auxiliary devices and mutual communication between the remote controller ECUs 60M and 60S is enabled.

Both the main remote controller ECU 60M and the sub remote controller ECU 60S are connected to the first communication bus 71 and the second communication bus 72, respectively. More specifically, the main remote controller ECU 60M has a first port P1 (input/output section) as a main output section and a second port P2 (input/output section) as a sub output section. Likewise, the sub remote controller ECU 60S has a first port P1 (input/output section) as a main output section and a second port P2 (input/output section) as a sub output section. The first communication bus 71 is connected to the respective first ports P1, and the second communication bus 72 is connected to the respective second ports P2. The first and second communication buses 71 and 72 are connected to the outboard motor ECUs 20 of all of the outboard motors 3L and 3R. The outboard motor ECUs 20 of the respective outboard motors 3L and 3R can thus perform communication with the main remote controller ECU 60M and the sub remote controller ECU 60S via the first communication bus 71 and the second communication bus 72.

Each of the main remote controller ECU 60M and the sub remote controller ECU 60S outputs control commands upon designating an outboard motor ECU 20 that is to be a communication destination. The designated outboard motor ECU 20 receives the control commands and controls the controlled objects (actuators) in accordance with the control commands. However, the outboard motor ECU 20 can also take in control commands, which are sent with the outboard motor ECU 20 of another outboard motor as a destination, and use the commands for control of the actuators.

The main remote controller ECU 60M sends out the control commands for control of the outboard motors 3 to the first port P1 and the second port P2. As in the first preferred embodiment, the control commands that the main remote controller ECU 60M sends out to the first port P1 shall be referred to as "marine vessel maneuvering control information," and the control commands that the main remote controller ECU 60M sends out to the second port P2 shall be referred to as "backup information." On the other hand, the sub remote controller ECU 60S sends out the control commands for control of the outboard motors 3 exclusively to the first port P1 and does not send out the control commands for control of the outboard motors 3 to the second port P2. The backup information is thus sent exclusively from the main remote controller ECU 60M.

Each of the main remote controller ECU 60M and the sub remote controller ECU 60S has a function of detecting a fault (in particular a disconnection fault) of the first communication bus 71 and the second communication bus 72. For example, each of the remote controller ECUs 60M and 60S sends a pilot signal at a fixed cycle to the outboard motor ECUs 20. Each outboard motor ECU 20 returns a response signal in response to the pilot signal. Each of the remote controller ECUs 60M and 60S can judge that a fault is occurring when, after sending the pilot signal, there is no response from the outboard motor ECUs 20 within a fixed time. Also, arrangements may be made such that fault detection of the communication buses 71 and 72 is performed at the outboard motor ECU 20 and the detection result is notified to the remote controller ECUs 60M and 60S via a communication bus in which a fault is not occurring. Besides the above, a fault detection circuit that monitors the signal levels of the communication buses 71 and 72 may be provided.

Each of the main remote controller ECU 60M and the sub remote controller ECU 60S holds data indicating which of the remote controller ECUs 60M and 60S is associated with which of the marine vessel maneuvering stations 5M and 5S. Further, each of the main remote controller ECU 60M and the sub remote controller ECU 60S holds effective station data indicating which of the marine vessel maneuvering stations 5M and 5S is made effective. Based on the effective station data, the remote controller ECUs 60M and 60S determines whether or not to respond to inputs from the steering apparatuses 6M and 6S, the remote controllers 7M and 7S, and other operation apparatuses. The remote controller ECU 60M or 60S responds to the inputs from the operation apparatuses and outputs the control commands when the effective station data indicate that a corresponding station is effective.

4-1. Control Example

When the main station 5M is made effective, operations are performed, for example, in accordance with the first control example in the above described first preferred embodiment. That is, the main remote controller ECU 60M sends out the marine vessel maneuvering control information at the predetermined first cycle to the first port P1 and sends out the backup information at the predetermined second cycle to the second port P2. The second cycle is set longer than the first cycle. The marine vessel maneuvering control information is thus sent to the first communication bus 71 at the first cycle, and the backup information is sent to the second communication bus 72 at the second cycle that is longer than the first cycle.

On the other hand, when the sub station 5S is made effective, the sub remote controller ECU 60S sends out the marine vessel maneuvering control information (control commands) to the first port P1 at the first cycle. As mentioned above, the sub remote controller ECU 60S does not send out the control commands to the second port P2. When a fault occurs in the first communication bus 71, the effective station data are rewritten such that the sub station 5S is made ineffective, and that the main station 5M is made effective.

The outboard motor ECUs 20 of the respective outboard motors 3 monitor the occurrence/non-occurrence of a fault of the first communication bus 71. In the normal state in which a fault is not occurring in the first communication bus 71, the respective outboard motor ECUs 20 control the actuators (controlled objects) based on the marine vessel maneuvering control information sent via the first communication bus 71. On the other hand, if it is determined that a fault is occurring in the first communication bus 71, the outboard motor ECUs 20 control the actuators in accordance with the backup information sent via the second communication bus 72. The outboard motor ECUs 20 can thus receive the control commands from the remote controller ECU 60 via the second communication bus 72 even when a fault occurs in the first communication bus 71. The control commands provided via the second communication bus 72 are renewed at each second cycle, and responsiveness of control thus becomes poor in comparison to the normal state. However, control of the outboard motors 3 by the remote controller ECU 60 is enabled in this state and the marine vessel 1 can be made to travel by operation of the outboard motors 3.

In the present control example, the outboard motor ECUs 20 of the respective outboard motors 3 may be arranged not to monitor the occurrence/non-occurrence of a fault of the first communication bus 71. The normal state in which a fault is not occurring in the first communication bus 71 is a state where the respective outboard motors ECUs 20 can receive information from either of the communication buses of the first communication bus and the second communication bus. In this state, the respective outboard motor ECUs 20 control the actuators (controlled objects) based on the marine vessel maneuvering control information, which is sent via the first communication bus 71 and is practically short in transmission cycle. On the other hand, a state in which a fault is occurring in the first communication bus 71 is a state in which the respective outboard motor ECUs 20 can acquire information from only the second communication bus. In this state, the outboard motor ECUs 20 control the actuators according to the backup information sent via the second communication bus 72. Thus, even if fault detection is not performed, the outboard motors ECU 20 can receive the control commands from the remote controller ECU 60 via the second communication bus 72 when a fault occurs in the first communication bus 71.

4-2. Operation of the Remote Controller ECUs

Figure 18:
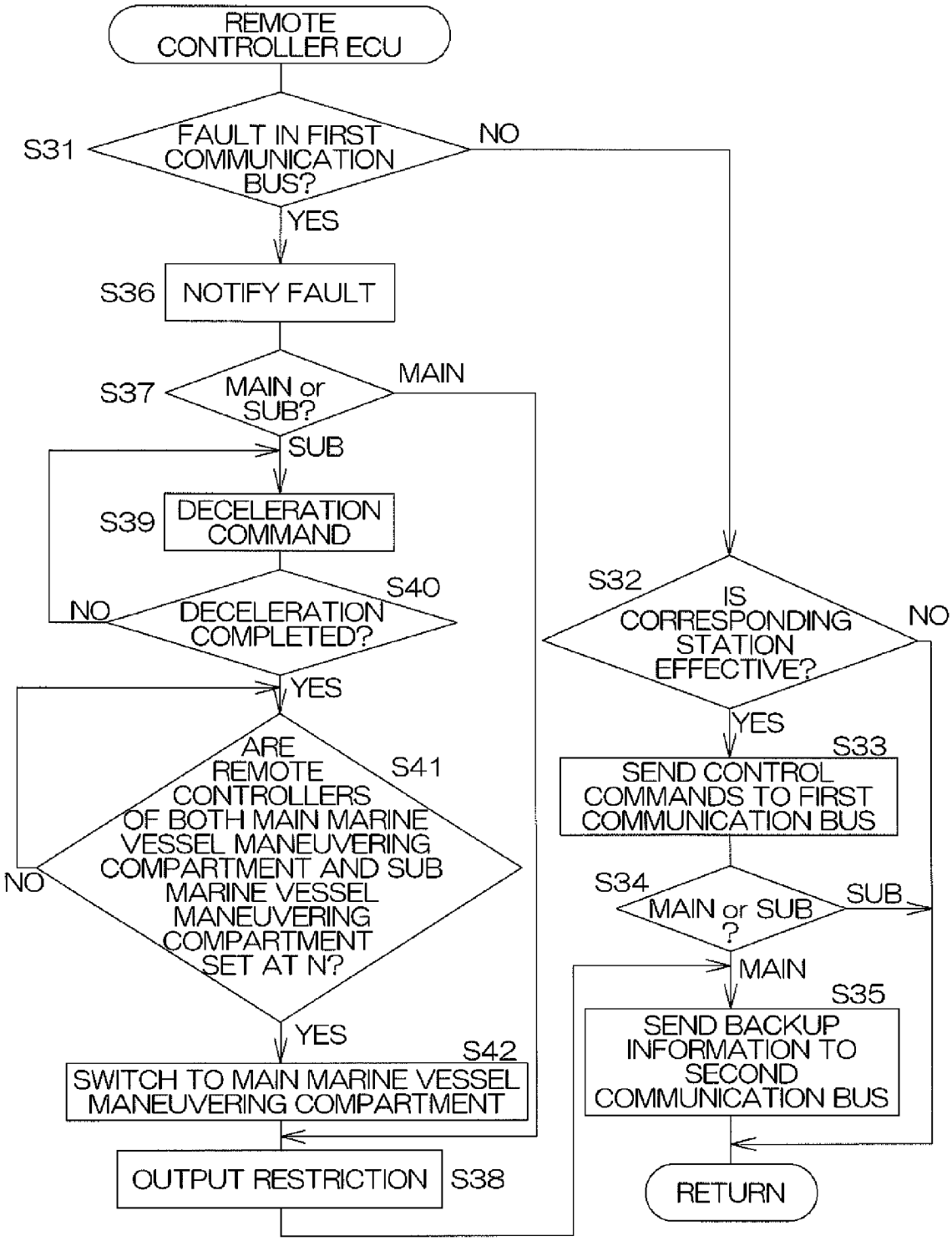
FIG. 18 is a flowchart for explaining a process executed by a remote controller ECU in the fourth preferred embodiment of the present invention.

FIG. 18 is a flowchart for explaining a process executed in each of the main remote controller ECU 60M and the sub remote controller ECU 60S. Each of the remote controller ECUs 60S and 60M monitors the occurrence/non-occurrence of a fault of the first communication bus 71 (step S31). If a fault is not occurring in the first communication bus 71, the effective station data are referenced to determine whether or not the corresponding station is effective (step S32). If the corresponding station is effective (step S32: YES), the remote controller ECU outputs the control commands (marine vessel maneuvering control information) to the first communication bus 71 via the first port P1 (step S33). Further, it is determined whether the corresponding station is the main station 5M or the sub station 5S (step S34). If the corresponding station is the main station 5M, the remote controller ECU sends out the backup information to the second communication bus 72 (step S35). However, as mentioned above, the cycle at which the backup information is sent is set longer than the sending cycle of the marine vessel maneuvering control information. The backup information is thus not sent if the time of the present cycle has not elapsed since the previous sending of the backup information. If the corresponding station is ineffective (step S32: NO), the remote controller ECU 60 outputs neither the marine vessel maneuvering control information nor the backup information.

If a fault is occurring in the first communication bus 71 (step S31: YES), the respective remote controller ECUs 60M and 60S notify the fault (step S36). For example, fault displays may be performed on the gauges 9M and 9S. Also, an indicator, buzzer, or other notifying apparatus for notifying the fault may be provided and such a notifying apparatus may be actuated.

Further, each of the remote controller ECUs 60M and 60S determines whether the corresponding station is the main station 5M or the sub station 5S (step S37). If the corresponding station is the main station 5M, the process of the main remote controller ECU 60M enters a process of restricting a maximum output (step S38). Specifically, an upper limit value of the target engine rotational speed is reduced from an ordinary value to a restricted value. For example, the main remote controller ECU 60M reduces the upper limit value of the target engine rotational speed from about 6,000 rpm (ordinary value) to about 2,000 rpm to about 3,000 rpm (restricted value). The backup information is output at a comparatively long cycle and the responsiveness of control becomes lower than that during the ordinary state. Thus, in this preferred embodiment, the lowering of responsiveness is accommodated by restricting the outputs of the outboard motors 3.

When the corresponding station is the sub station 5S (step S37), the sub remote controller ECU 60S outputs a deceleration command (stop command) to the first port P1 (step S39). Specifically, the sub remote controller ECU 60S generates a control command with which the target engine rotational speed is set to the idling rotational speed and the target shift position is set to the neutral position. The output of this control command is continued until deceleration of the marine vessel 101 is completed and the marine vessel 101 stops (step S40). The completion of deceleration can be determined, for example, based on the marine vessel speed signal from the triducer 83.

When the deceleration is completed (step S40: YES), the sub remote controller ECU 60S determines whether or not the operation positions of the two operation levers 7L and 7R of each of the main remote controller 7M and the sub remote controller 7S are both at the neutral positions (N) (step S41). The operation position information of the main remote controller 7S can be acquired from the main remote controller ECU 60M via the first communication bus 71 or the second communication bus 72. After waiting for the operation positions of all of the levers of the main remote controller 7M and the sub remote controller 7S to be set at the neutral positions (step S41), the sub remote controller ECU 60S switches the effective marine vessel maneuvering station from the sub station 5S to the main station 5M (step S42). Specifically, the sub remote controller ECU 60S rewrites its own effective station data to "main station." Further, the sub remote controller ECU 60S commands, via the second communication bus 72, the main remote controller ECU 60M to rewrite the effective station data to "main station." The main station 5M is thereby made effective.

When the control by the main remote controller ECU 60M is made effective, the main remote controller ECU 60M restricts the outputs of the outboard motors 3 (step S38). The subsequent control is executed within the restricted output range. That is, the main remote controller ECU 60M sends out the backup information, which includes the control commands for operating the outboard motors 3 within the restricted output range, to the second communication bus 72 from the second port P2 (step S35).

Thus, by this preferred embodiment, the backup information is exclusively sent from the main remote controller ECU 60M to the second communication bus 72 and the sub remote controller ECU 60S does not perform sending of the backup information to the second communication bus 72. A plurality of marine vessel maneuvering stations can thus be set up without having to significantly increase the communication capacity of the second communication bus 72.

In a case where a plurality of sub stations are to be set up, the arrangement of each of the plurality of sub stations is preferably substantially the same as the arrangement of the sub station 5S described above. That is, when a fault occurs in the first communication bus 71 while one of the sub stations is effective, switching to control by the main station 5M is performed automatically and the outboard motors 3 are controlled in accordance with the backup information generated by the main remote controller ECU 60M.

4-3. Other Control Examples

Control in the same manner can be performed in a case where the number of outboard motors 3 is one as well as in cases where there are not less than three outboard motors.

Further, the respective second control examples of the first to third preferred embodiments can be applied in cases where a plurality of the outboard motors 3 are provided. Also, in a case where three outboard motors 3 are provided, the third control example in the first preferred embodiment may be applied. Further, in a case where four outboard motors 3 are provided, the third control example in the second preferred embodiment may be applied. Also, in a case where five outboard motors 3 are provided, the third control example in the third preferred embodiment may be applied. In all cases the backup information is output only by the main remote controller ECU 60M.

5. Fifth Preferred Embodiment

Figure 19:
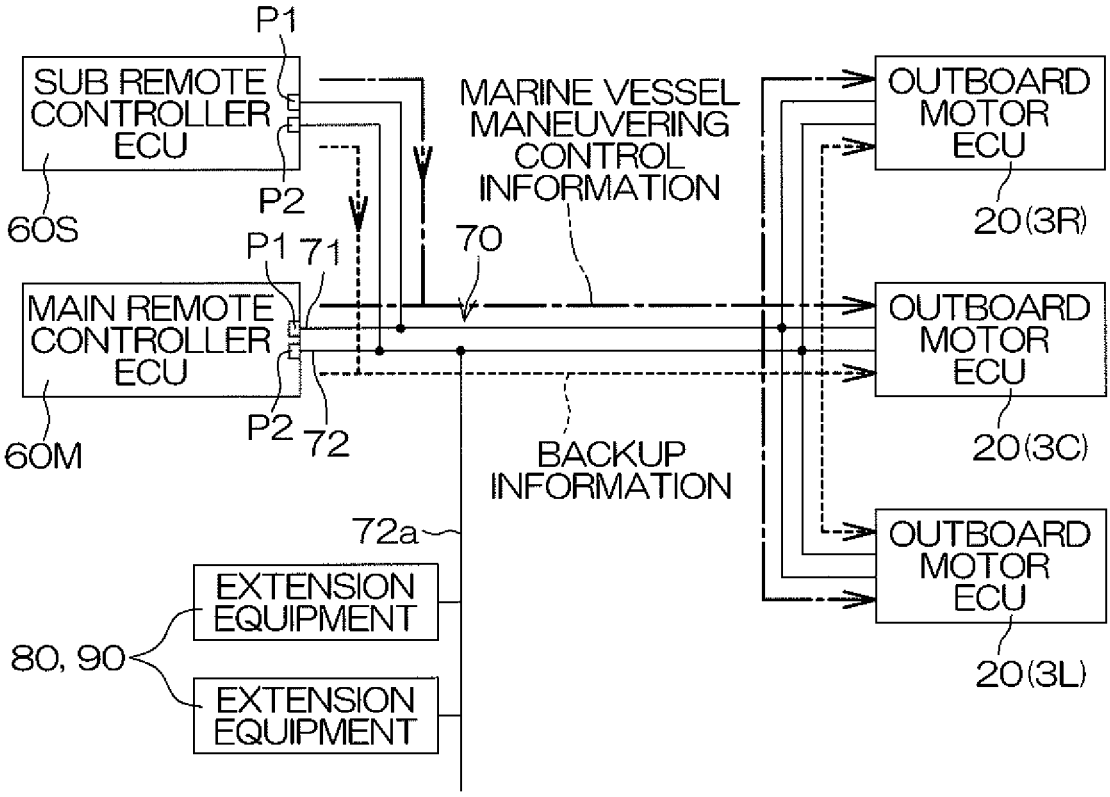
FIG. 19 is a schematic block diagram for explaining a fifth preferred embodiment of the present invention.

FIG. 19 is a schematic block diagram for explaining a fifth preferred embodiment of the present invention. In the description of this preferred embodiment, the above-described FIG. 16 and FIG. 17 are referenced again. However, a case where three outboard motors 3R, 3C, and 3L are preferably aligned in a single row in the right/left direction at the stern is illustrated in FIG. 19.

In the fourth preferred embodiment described above, the sub remote controller ECU 60S of the sub station 5S does not send the backup information. In the fifth preferred embodiment, on the other hand, the sub remote controller ECU 60S sends out the backup information to the second port P2 while sending out the marine vessel maneuvering control information to the first port P1. That is, in regard to the output of the marine vessel maneuvering control information and the backup information, the sub remote controller ECU 60S has substantially the same function as the main remote controller ECU 60M. There is thus no need to automatically switch the marine vessel maneuvering station to the main station 5M when a fault occurs in the first communication bus 71.

Thus, in the present preferred embodiment, both the main remote controller ECU 60M and the sub remote controller ECU 60S can be made to perform substantially the same control operations as the remote controller ECUs 60 in the first to third preferred embodiments. This shall be described specifically below.

5-1. First Control Example

As the first control example, substantially the same control as in the first control example (see FIG. 4) of the first preferred embodiment is possible. That is, when the corresponding marine vessel maneuvering station is effective, each of the remote controller ECUs 60M and 60S sends out the marine vessel maneuvering control information to the first port P1 at the predetermined first cycle, and sends out the backup information to the second port P2 at the predetermined second cycle. The second cycle is set longer than the first cycle.

The outboard motor ECUs 20 of the respective outboard motors 3 monitor the occurrence/non-occurrence of a fault of the first communication bus 71. In the normal state in which a fault is not occurring in the first communication bus 71, the respective outboard motor ECUs 20 control the actuators based on the marine vessel maneuvering control information sent via the first communication bus 71. On the other hand, if it is determined that a fault is occurring in the first communication bus 71, the outboard motor ECUs 20 control the actuators in accordance with the backup information sent via the second communication bus 72.

In the first control example, the outboard motor ECUs 20 of the respective outboard motors 3 may be arranged not to monitor the occurrence/non-occurrence of a fault of the first communication bus 71. The normal state in which a fault is not occurring in the first communication bus 71 is a state where the respective outboard motors ECUs 20 can receive information from either of the communication buses of the first communication bus and the second communication bus. In this state, the respective outboard motor ECUs 20 control the actuators (controlled objects) based on the marine vessel maneuvering control information, which is sent via the first communication bus 71 and is practically short in transmission cycle. On the other hand, a state in which a fault is occurring in the first communication bus 71 is a state in which the respective outboard motor ECUs 20 can acquire information from only the second communication bus. In this state, the outboard motor ECUs 20 control the actuators according to the backup information sent via the second communication bus 72. Thus, even if fault detection is not performed, the outboard motors ECU 20 can receive the control commands from the remote controller ECU 60 via the second communication bus 72 when a fault occurs in the first communication bus 71.

5-2. Second Control Example

A second control example applicable to the present preferred embodiment is substantially the same as the second control example in the above described first preferred embodiment (see FIG. 5). That is, when the corresponding marine vessel maneuvering station is effective, each of the remote controller ECUs 60M and 60S sends out the marine vessel maneuvering control information to the first port P1 and sends out the backup information to the second port P2. The sending cycles of the marine vessel maneuvering control information and the backup information may be equal or the sending cycle of the backup information may be longer than the sending cycle of the marine vessel maneuvering control information.

The marine vessel maneuvering control information includes the control commands for all of the outboard motors 3. In contrast, the backup information includes only the control commands for a portion of the outboard motors 3. The information volume per unit time of the backup information is thus less than the information volume per unit time of the marine vessel maneuvering control information.

More specifically, the backup information may include only the control commands for the central outboard motor 3C. Thus, when a fault occurs in the first communication bus 71, operations of the port-side outboard motor 3L and the starboard-side outboard motor 3R are stopped and only the central outboard motor 3C is operable. The marine vessel 1 can thus be made to travel, albeit in a mode that is more restricted than the ordinary state. Preferably, the steering angle is controlled to be zero at the port-side outboard motor 3L and the starboard-side outboard motor 3R.

The backup information may instead include only the control commands for the port-side outboard motor 3L and the starboard-side outboard motor 3R and not include the control commands for the central outboard motor 3C. In this case, when a fault occurs in the first communication bus 71, the operation of the central outboard motor 3C is stopped and only the port-side outboard motor 3L and the starboard-side outboard motor 3R are operable. The marine vessel 1 can thus be made to travel, albeit in a mode that is more restricted than the ordinary state. Preferably, the steering angle is controlled to be zero at the central outboard motor 3C. Alternatively, when a fault occurs in the first communication bus 71, operation of the engine at the idling rotational speed may be performed instead of stopping of operation at the outboard motor for which the control commands are not included in the backup information. In this case, the shift position is preferably controlled to be the neutral position.

Further, when a fault occurs in the first communication bus 71, the outboard motor ECU 20 of the central outboard motor 3C may perform control of the actuators based on the port-side commands and the starboard-side commands. The control of the central outboard motor 3C in this case may be substantially the same as that in the case of the second control example of the first preferred embodiment. The marine vessel 101 can thereby be made to travel by actuating all three outboard motors 3 even when a fault occurs in the first communication bus 71.

5-3. Third Control Example

A third control example applicable to the present preferred embodiment is the same as the third control example in the above described first preferred embodiment (see FIG. 6). That is, when the corresponding marine vessel maneuvering station is effective, each of the remote controller ECUs 60M and 60S sends out the marine vessel maneuvering control information to the corresponding first port P1 and sends out the backup information to the corresponding second port P2. The sending cycles of the marine vessel maneuvering control information and the backup information may be equal or the sending cycle of the backup information may be longer than the sending cycle of the marine vessel maneuvering control information. In the present control example, the backup information includes the control commands for the starboard-side outboard motor 3R and the control commands for the port-side outboard motor 3L and does not include the control commands for the central outboard motor 3C.

In the normal state in which a fault is not occurring in the first communication bus 71, the outboard motor ECUs 20 of the respective outboard motors 3 control the actuators (controlled objects) based on the marine vessel maneuvering control information sent via the first communication bus 71. On the other hand, when a fault occurs in the first communication bus 71, the outboard motor ECU 20 executes the control operation that is in accordance with the position of the corresponding outboard motor 3. That is, in the case where the corresponding outboard motor 3 is the starboard-side outboard motor 3R, the outboard motor ECU 20 controls the actuators of the corresponding starboard-side outboard motor 3R based on the starboard-side outboard motor control commands (starboard-side commands) included in the backup information sent via the second communication bus 72. Also, if the corresponding outboard motor is the port-side outboard motor 3L, the outboard motor ECU 20 controls the actuators of the corresponding port-side outboard motor 3L based on the port-side outboard motor control commands (port-side commands) included in the backup information sent via the second communication bus 72. And if the corresponding outboard motor is the central outboard motor 3C, the outboard motor ECU 20 controls the actuators of the corresponding central outboard motor 3C based on the starboard-side commands and the port-side commands included in the backup information sent via the second communication bus 72. The control of the central outboard motor 3C based on the starboard-side commands and the port-side commands may be performed in substantially the same manner as in the third control example of the first preferred embodiment. The marine vessel 1 can thereby be made to travel by operating all of the outboard motors 3 even when a fault occurs in the first communication bus 71.

5-4. Fourth Control Example

A fourth control example applicable to the present preferred embodiment is substantially the same as the fourth control example in the above described first preferred embodiment (see FIG. 7). That is, when the corresponding marine vessel maneuvering station is effective, each of the remote controller ECUs 60M and 60S sends out the marine vessel maneuvering control information to the corresponding first port P1 and sends out the backup information to the corresponding second port P2. The sending cycles of the marine vessel maneuvering control information and the backup information may differ but are preferably equal.

In the present control example, the marine vessel maneuvering control information includes the control commands (starboard-side commands) for the starboard-side outboard motor 3R and the control commands (port-side commands) for the port-side outboard motor 3L but does not include the control commands (central commands) for the central outboard motor 3C. The backup information includes the control commands (central commands) for the central outboard motor 3C but does not include either the starboard-side commands or the port-side commands. The information volume per unit time of the backup information is thus less than the information volume per unit time of the marine vessel maneuvering control information.

The outboard motor ECUs 20 of the starboard-side outboard motor 3R and the port-side outboard motor 3L respectively monitor the occurrence/non-occurrence of a fault of the first communication bus 71. In the normal state in which a fault is not occurring in the first communication bus 71, the outboard motor ECUs 20 of the starboard-side outboard motor 3R and the port-side outboard motor 3L control the actuators based respectively on the starboard-side commands and the port-side commands. Also, at the central outboard motor 3C, the actuators are controlled according to the central commands included in the backup information sent via the second communication bus 72.

On the other hand, if it is determined that a fault is occurring in the first communication bus 71, the outboard motor ECUs 20 of the starboard-side outboard motor 3R and the port-side outboard motor 3L stop the control of the actuators. In this case, the engines of the starboard-side outboard motor 3R and the port-side outboard motor 3L may be put in a stopped state or in an idling rotation state. The shift position is controlled to be the neutral position and the steering angle is controlled to be zero. Even in this case, traveling of the marine vessel 1 is enabled because the central outboard motor 3C is controlled in accordance with the central commands included in the backup information.

All of the outboard motors 3 can thus be controlled by the first communication bus 71 and the second communication bus 72 complementing each other in the ordinary state. Then, when a fault occurs in the first communication bus 71, the central outboard motor 3C can be operated by the central commands in the backup information transmitted via the second communication bus 72.

When a fault occurs in the second communication bus 72, the starboard-side and the port-side outboard motors 3R and 3L can be operated by the starboard-side commands and the port-side commands transmitted via the first communication bus 71 and the marine vessel 1 can thus be made to travel in this state as well. In this case, the engine of the central outboard motor 3C may be set to the stopped state or the idling rotation state. The shift position is controlled to be the neutral position and the steering angle is controlled to be zero.

5-5. Application to Different Numbers of Outboard Motors

This preferred embodiment can be applied to a case where the number of the outboard motor 3 is one, a case where the number is two, a case where the number is four, and a case where the number is five, for example.

When the number of the outboard motor 3 is one, the remote controller ECUs 60M and 60S and the outboard motor ECU 20 are arranged to operate in accordance with the first control example described above.

In the case where the number of the outboard motors 3 is two, in addition to being able to apply the first control example, the second and fourth control examples can be applied upon modification. In the case where the second control example is applied, the marine vessel maneuvering control information includes the control commands for the two outboard motors 3, and the backup information includes only the control commands for the starboard-side or the port-side outboard motor 3. In the case where the fourth control example is applied, the marine vessel maneuvering control information includes the control commands for only one of the two outboard motors 3, and the backup information includes the control commands for only the other of the two outboard motors 3.

In the case where the number of the outboard motors 3 is four, the first to fourth control examples in the second preferred embodiment can be applied. Also, in the case where the number of the outboard motors 3 is five, the first to fourth control examples in the third preferred embodiment can be applied.

6. Other Preferred Embodiments

Although five preferred embodiments of the present invention have been described above, the present invention can be put into practice in many other modes as well. For example, although in the preferred embodiments described above, each of the remote controller ECUs 60, 60M, and 60S preferably has a function of processing signals from the steering apparatus 6, a control unit (steering ECU) for the steering apparatus 6 may be provided separately from the remote controller ECU 60. Preferably, in this case, the first communication bus 71 is connected to a first port of the steering ECU and the second communication bus 72 is connected to a second port of the steering ECU. The steering ECU outputs the marine vessel maneuvering control information to the first information bus 71 and outputs the backup information to the second communication bus 72. In this case, the target steering angle is included as a control command in the marine vessel maneuvering control information and the backup information.

Also, one of either the output control or the steering control may be performed by mechanical transmission of an operational force instead of by transmission of electrical signals. Specifically, the remote control lever and the outboard motor may be coupled by a cable, so that change of the shift position and change of the throttle opening are performed by mechanical transmission of the operation of the remote control lever to the outboard motor. Also, the steering handle and the steering mechanism may be coupled by a cable, so that change of the steering angle of the outboard motor is performed by mechanical transmission of the operation of the steering handle to the steering mechanism. In all of these cases, the present invention can be applied in regard to the control (output control or steering control) that is performed by the transmission of electrical signals.

Also, although with the first to third preferred embodiments described above, cases where a plurality of outboard motors are installed have been described, as described in relation to the fourth and fifth preferred embodiments, the present invention is also applicable to a marine vessel having only a single outboard motor. Also, there may be only one marine vessel maneuvering station.

Further, although, restriction of the output of the outboard motor 3 upon occurrence of a fault in the first communication bus 71 has been described above in relation to the fourth preferred embodiment, substantially the same control is preferably performed in the first to third and fifth preferred embodiments as well. Lowering of responsiveness due to dependence on the backup information transmitted via the second communication bus 72 can thereby be accommodated.

Also, although with the preferred embodiments described above, the starting command, the target engine rotational speed, the target shift position, and the target steering angle have been cited as examples of control commands, any combination of these is also merely an example of a control command. At least the starting command have to be included among the control commands included in the marine vessel maneuvering control information and the backup information. By the starting command being included, the starting of the outboard motor 3 is enabled and the marine vessel can thus be made to travel even when a fault occurs in the first communication bus 71.

Further, although with the preferred embodiments described above, the outboard motor 3 having the engine (internal combustion engine) as the drive source, has been cited as an example, the present invention can also be applied to an outboard motor having an electric motor as the drive source. Further, as mentioned above, the present invention is not restricted to an outboard motor and can be applied to a marine vessel that includes a marine vessel propulsion device of another form, such as an inboard motor, an inboard/outboard motor, a water jet drive, etc.

Besides the above, various design changes within the scope of matters described in the claims are possible.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2009-131388 filed in the Japan Patent Office on May 29, 2009, and the entire disclosure of the application is incorporated by reference.

What is claimed is:

1. A marine vessel control system for a marine vessel that includes at least one marine vessel propulsion device, the marine vessel control system comprising:

a control unit including a main output section arranged to output marine vessel maneuvering control information including starting information of the at least one marine vessel propulsion device, and a sub output section arranged to output backup information including the starting information of the at least one marine vessel propulsion device;

a first communication bus connected to the at least one marine vessel propulsion device and the control unit, and arranged to transmit the marine vessel maneuvering control information, output from the main output section, to the at least one marine vessel propulsion device;

a second communication bus connected to the at least one marine vessel propulsion device and the control unit, and arranged to transmit the backup information, output from the sub output section, to the at least one marine vessel propulsion device; and an auxiliary device connection section provided in the second communication bus, and arranged to enable connection of an auxiliary device that executes communication, related to auxiliary information other than the marine vessel maneuvering control information, with at least one of the marine vessel propulsion device and the control unit via the second communication bus; wherein no auxiliary device connection section is provided in the first communication bus;

the first communication bus is arranged to not transmit the auxiliary information; and the second communication bus is arranged to transmit the auxiliary information.

2. The marine vessel control system according to claim 1, wherein the sub output section is arranged to output the backup information that is lower in information volume per unit time than the marine vessel maneuvering control information output by the main output section.

3. The marine vessel control system according to claim 2, wherein the sub output section is arranged to output the backup information in a communication cycle that is longer than a communication cycle in which the main output section outputs the marine vessel maneuvering control information.

4. The marine vessel control system according to claim 1, wherein the marine vessel includes a plurality of the marine vessel propulsion devices, and each of the plurality of marine vessel propulsion devices is connected to the first communication bus and the second communication bus.

5. The marine vessel control system according to claim 4, wherein the sub output section is arranged to transmit the backup information via the second communication bus only to some of the marine vessel propulsion devices among the plurality of marine vessel propulsion devices.

6. The marine vessel control system according to claim 5, wherein the marine vessel control system is provided in a marine vessel in which an odd number, not less than three, of the marine vessel propulsion devices are attached in alignment in a single row along a right/left direction of a hull, and the sub output section is arranged to output, as the backup information, a command for a single marine vessel propulsion device arranged at a center of the single row.

7. The marine vessel control system according to claim 5, wherein the marine vessel control system is provided in a marine vessel in which an even number, not less than four, of the marine vessel propulsion devices are attached in alignment in a single row along a right/left direction of a hull, and the sub output section is arranged to output, as the backup information, a command for two marine vessel propulsion devices arranged at a center of the single row.

8. The marine vessel control system according to claim 5, wherein the marine vessel control system is provided in a marine vessel in which not less than three of the marine vessel propulsion devices are attached in alignment in a single row along a right/left direction of a hull, and the sub output section is arranged to output, as the backup information, a port-side command for the marine vessel propulsion device at a port-most side of the single row and a starboard-side command for the marine vessel propulsion device at a starboard-most side of the single row.

9. The marine vessel control system according to claim 8, wherein the number of the marine vessel propulsion devices is three, and the marine vessel propulsion device at a center is arranged to operate based on the port-side command and the starboard-side command when a fault occurs in the first communication bus.

10. The marine vessel control system according to claim 8, wherein the number of the marine vessel propulsion devices is four, and the marine vessel propulsion devices at a left side relative to a center are arranged to operate based on the port-side command and the marine vessel propulsion devices at a right side relative to the center are arranged to operate based on the starboard-side command when a fault occurs in the first communication bus.

11. The marine vessel control system according to claim 5, wherein the marine vessel control system is provided in a marine vessel in which five of the marine vessel propulsion devices are attached in alignment in a single row along a right/left direction of a hull, and the sub output section is arranged to output, as the backup information, a port-side command for the marine vessel propulsion device at the port-most side of the single row, a central command for the marine vessel propulsion device at a center of the single row, and a starboard-side command for the marine vessel propulsion device at the starboard-most side of the single row.

12. The marine vessel control system according to claim 11, wherein when a fault occurs in the first communication bus, the marine vessel propulsion devices at a left side relative to the center are arranged to operate based on the port-side command, the marine vessel propulsion devices at a right side relative to the center are arranged to operate based on the starboard-side command, and the marine vessel propulsion device at the center is arranged to operate based on the central command.

13. The marine vessel control system according to claim 5, wherein the main output section is arranged to output marine vessel maneuvering control information for some of the marine vessel propulsion devices among the plurality of marine vessel propulsion devices, and the sub output section is arranged to output, as the backup information, commands to the marine vessel propulsion devices other than the marine vessel propulsion devices that are subject to the marine vessel maneuvering control information.

14. The marine vessel control system according to claim 13, wherein the number of the plurality of marine vessel propulsion devices is not less than three, and the main output section is arranged to output the marine vessel maneuvering control information that includes a port-most side command for the marine vessel propulsion device at the port-most side and a starboard-most side command for the marine vessel propulsion device at the starboard-most side.

15. The marine vessel control system according to claim 1, wherein the marine vessel includes a single main marine vessel maneuvering compartment and not less than one sub marine vessel maneuvering compartment, a plurality of the control units are provided respectively in the plurality of marine vessel maneuvering compartments, and the first communication bus and the second communication bus are connected to the plurality of control units.

16. The marine vessel control system according to claim 15, wherein the control unit of the main marine vessel maneuvering compartment is arranged to output the backup information to the second communication bus, and the control unit of each sub marine vessel maneuvering compartment is arranged so as not to output the backup information.

17. The marine vessel control system according to claim 15, further comprising a switching unit arranged to operate such that if marine vessel maneuvering is being performed at the sub marine vessel maneuvering compartment when a fault occurs in the first communication bus, the marine vessel propulsion device is controlled to stop the marine vessel and the compartment at which marine vessel maneuvering is performed is switched from the sub marine vessel maneuvering compartment to the main marine vessel maneuvering compartment.

18. A marine vessel propulsion system comprising:

at least one marine vessel propulsion device;

a control unit including a main output section arranged to output marine vessel maneuvering control information including starting information of the at least one marine vessel propulsion device, and a sub output section arranged to output backup information including the starting information of the at least one marine vessel propulsion device;

a first communication bus connected to the at least one marine vessel propulsion device and the control unit, and arranged to transmit the marine vessel maneuvering control information, output from the main output section, to the at least one marine vessel propulsion device;

a second communication bus connected to the at least one marine vessel propulsion device and the control unit, and arranged to transmit the backup information, output from the sub output section, to the at least one marine vessel propulsion device; and an auxiliary device connected to the second communication bus, and arranged to execute communication, related to auxiliary information other than the marine vessel maneuvering control information, with at least one of the at least one marine vessel propulsion device and the control unit via the second communication bus; wherein no auxiliary device is connected to the first communication bus;

the first communication bus is arranged to not transmit the auxiliary information; and the second communication bus is arranged to transmit the auxiliary information.

19. A marine vessel comprising:

a hull;

at least one marine vessel propulsion device attached to the hull;

a control unit including a main output section arranged to output marine vessel maneuvering control information including starting information of the at least one marine vessel propulsion device, and a sub output section arranged to output backup information including the starting information of the at least one marine vessel propulsion device;

a first communication bus connected to the at least one marine vessel propulsion device and the control unit, and arranged to transmit the marine vessel maneuvering control information, output from the main output section, to the at least one marine vessel propulsion device;

a second communication bus connected to the at least one marine vessel propulsion device and the control unit, and arranged to transmit the backup information, output from the sub output section, to the at least one marine vessel propulsion device; and an auxiliary device connected to the second communication bus, and arranged to execute communication, related to auxiliary information other than the marine vessel maneuvering control information, with at least one of the at least one marine vessel propulsion device and the control unit via the second communication bus; wherein no auxiliary device is connected to the first communication bus;

the first communication bus is arranged to not transmit the auxiliary information; and the second communication bus is arranged to transmit the auxiliary information.

* * * * *